US011124908B2

(12) United States Patent
Suzuki et al.

(10) Patent No.: US 11,124,908 B2
(45) Date of Patent: Sep. 21, 2021

(54) THREAD FEEDING DEVICE OF DECORATIVE STITCH SEWING MACHINE

(71) Applicant: SUZUKI MANUFACTURING, LTD., Yamagata (JP)

(72) Inventors: Mitsuharu Suzuki, Yamagata (JP); Tohru Sakuma, Yamagata (JP)

(73) Assignee: SUZUKI MANUFACTURING, LTD., Yamagata (JP)

( * ) Notice: Subject to any disclaimer, the term of this patent is extended or adjusted under 35 U.S.C. 154(b) by 0 days.

(21) Appl. No.: 16/630,561

(22) PCT Filed: Apr. 24, 2018

(86) PCT No.: PCT/JP2018/016598
§ 371 (c)(1),
(2) Date: Jan. 13, 2020

(87) PCT Pub. No.: WO2019/038991
PCT Pub. Date: Feb. 28, 2019

(65) Prior Publication Data

US 2021/0087728 A1 Mar. 25, 2021

(30) Foreign Application Priority Data

Aug. 22, 2017 (JP) ..... JP2017-159251

(51) Int. Cl.
*D05B 9/00* (2006.01)
*D05B 47/04* (2006.01)
*D05B 57/06* (2006.01)

(52) U.S. Cl.
CPC ..... *D05B 9/00* (2013.01); *D05B 47/04* (2013.01); *D05B 57/06* (2013.01)

(58) Field of Classification Search
CPC ..... D05B 9/00; D05B 45/00; D05B 47/04; D05B 49/02; D05B 57/06
See application file for complete search history.

(56) References Cited

U.S. PATENT DOCUMENTS 5,138,961 A * 8/1992 Nakano ..... D05B 45/00 112/163
5,934,211 A * 8/1999 Sakuma ..... D05B 47/04 112/255
6,167,825 B1 * 1/2001 Marchetti ..... A41D 27/24 112/162

FOREIGN PATENT DOCUMENTS

JP H10235043 A 9/1998
JP H10235044 A 9/1998
(Continued)

*Primary Examiner* — Nathan E Durham
(74) *Attorney, Agent, or Firm* — Bacon & Thomas, PLLC

(57) ABSTRACT

The present invention provides a thread feeding device of a decorative stitching sewing machine. The thread feeding device feeds a needle thread, an upper looper thread, and a lower looper thread in the amounts required for sewing one stitch such that the position of a stitch looping point of the threads changes. The thread feeding device includes: a thread accumulator 500 having thread accumulating elements 13*a* to 13*d* and 14*a* to 14*d* which measure the thread accumulation amounts of predetermined lengths of the needle thread, the upper looper thread, and the lower looper thread, and thread accumulation amount control elements 15 to 18 which adjust the amounts of the threads required for sewing one stitch in an increasable and decreasable manner within the range of thread accumulation amounts of predetermined lengths at the time of fabric feeding, and which release the threads to a stitch forming device when a stitch is formed; a thread feed drive mechanism 600 which drives each of the elements; and a thread feed control unit having a program which dives the thread accumulation amount control elements for each stitch to feed the threads in an increasable and decreasable manner so as to increase or decrease the threads within the range of a total thread feeding amount that is maintained constant, including a fabric feeding amount, a fabric thickness and an overlocking
(Continued)

width, thereby to change the position of the stitch looping point of the needle thread, the upper looper thread, and the lower looper thread, thus controlling the decorative stitching according to a stitching decoration pattern.

18 Claims, 20 Drawing Sheets

(56) References Cited

FOREIGN PATENT DOCUMENTS

| | | | |
|---|---|---|---|
| JP | H10235045 | A | 9/1998 |
| JP | H10235058 | A | 9/1998 |
| JP | H10244088 | A | 9/1998 |
| JP | H10249084 | A | 9/1998 |
| JP | H10272273 | A | 10/1998 |
| JP | H119872 | A | 1/1999 |
| JP | 2002-315984 | A | 10/2002 |
| JP | 2004305381 | A | 11/2004 |
| JP | 2005304814 | A | 11/2005 |
| JP | 3877829 | B2 | 2/2007 |
| JP | 4109147 | B2 | 7/2008 |

* cited by examiner

ACCUMULATING THREAD IN AMOUNT REQUIRED FOR ONE STITCH

RELEASING ACCUMULATED THREAD

THREAD FEEDING DEVICE OF DECORATIVE STITCH SEWING MACHINE

TECHNICAL FIELD

The present invention relates to a thread feeding device of a decorative stitch sewing machine and more particularly to a thread feeding device of a decorative stitch sewing machine which eliminates the need for a thread tension adjustment operation and which feeds sewing threads to a stitch forming device adapted to form stitches on fabric.

BACKGROUND ART

Hitherto, there has been known a decorative stitch sewing machine that performs undulating (sine-curve shaped) decorative stitching (refer to, for example, Patent Literatures 1 and 2).

According to the decorative stitch sewing machine, a thread feeding device which feeds sewing threads to form a stitch is configured to include:

an upstream gripper which grips a needle thread, an upper looper thread, and a lower looper thread fed from spools to a needle, an upper looper, and a lower looper, which is closed by a stitch forming device at the time of forming a stitch and opened at the time of feeding a fabric, and a downstream gripper which grips sewing threads introduced from the upstream gripper, which is opened to draw out the sewing threads by the stitch forming device when forming a stitch, and which is closed at the time of feeding the fabric;

a regular sewing reciprocator which is driven in synchronization with the stitch forming device, which shifts the sewing threads in thread paths extending between the upstream gripper opened at the time of feeding the fabric and the downstream gripper closed at the time of feeding the fabric as the sewing threads in amounts required for forming a stitch by the stitch forming device, and which releases the sewing threads at the time of forming the stitch; and a modified sewing reciprocator which is driven in synchronization with the stitch forming device, which shifts the sewing threads to change the sewing thread amount of each sewing thread required for sewing one stitch such that the sum of the sewing thread amount of one of at least two sewing threads on a thread path extending between the upstream gripper opened at the time of feeding the fabric and the downstream gripper closed at the time of feeding the fabric and the sewing thread amount of the other remains constant and as the sewing thread amount of one increases, the sewing thread amount of the other decreases, and which releases the sewing threads at the time of forming the stitch.

Further, there has been known an overlock sewing machine in which the sewing threads including a needle thread, an upper looper thread and a lower looper thread of a needle, an upper looper and a lower looper, respectively, are fed to a stitch forming device by pulse motors (refer to, for example, Patent Literatures 3 to 11).

CITATION LIST

Patent Literature

Patent Literature 1: JP 3877829 B
Patent Literature 2: JP 4109147 B
Patent Literature 3: JP2002-315984 A
Patent Literature 4: JP2005-304814 A
Patent Literature 5: JP H10 (1998)-235043 A
Patent Literature 6: JP H10 (1998)-235044 A Patent Literature 7: JP H10 (1998)-235045 A
Patent Literature 8: JP H10 (1998)-235058 A
Patent Literature 9: JP H10 (1998)-244088 A
Patent Literature 10: JP H10 (1998)-249084 A
Patent Literature 11: JP H11 (1999)-9872 A

SUMMARY OF INVENTION

Technical Problem

However, the thread feeding devices described in Patent Literatures 1 and 2 have a drawback described below. All of the sewing threads including the needle thread, the upper looper thread and the lower looper thread of the needle, the upper looper and the lower looper, respectively, depend on a single thread feed control system, so that only the decorative stitching that uses one type of stitching decoration pattern planned and designed in advance can be performed. Further, despite the intended operation in which the thread path of the upper looper thread is changed and the thread path of the upper looper is changed to, for example, the thread path of a needle not yet threaded with the needle thread, and further, a modified sewing reciprocator is separately provided to keep the total amount of the upper looper thread and the lower looper thread constant, the aforesaid total amount cannot be maintained constant in an actual operation due to the dependence on the single thread feed control system, thus failing to form beautiful stitches of stitching decoration.

Further, the overlock sewing machine described in Patent Literature 3 has a drawback described below. The manual adjustment knobs of the thread tensioners for all sewing threads, including a needle thread, an upper looper thread and a lower looper thread of the needle, the upper looper and the lower looper, respectively, have been substituted by separate pulse motors, and the total stitch balance of a stitching decoration pattern is not considered. Each of the pulse motors requires that a correction or adjustment be made by additional operations according to the stitching decoration pattern, the type of sewing thread, the thickness of sewing thread, fabric thickness, sewing width and the like. This makes it difficult to correlate the correction or adjustment operation to a stitch finish.

Further, the overlock sewing machines described in Patent Literatures 4 to 11 have a drawback described below. Although the thread feeding of all sewing threads, including a needle thread, an upper looper thread and a lower looper thread of a needle, an upper looper and a lower looper, respectively, can be individually controlled by separate pulse motors, the threads are directly fed by the individual pulse motors for feeding the threads, so that the total stitch balance of a stitching decoration pattern is not considered. Thus, a correction or adjustment is required as a preparatory operation for each pulse motor, which is an additional operation, according to a stitching decoration pattern, the type of sewing thread, the thickness of sewing thread, fabric thickness, sewing width, and the like. This makes it difficult to correlate the correction or adjustment operation to a stitch finish.

The present invention has been made to overcome the drawbacks described above, and an object of the invention is to provide a thread feeding device of a decorative stitch sewing machine, which thread feeding device is capable of performing decorative stitchng in multiple types of stitching decoration patterns by supplying and accumulating in advance a plurality of sewing threads, including a needle thread, an upper looper thread and a lower looper thread, in sewing thread amounts necessary for each stitch such that the position of a stitch looping point is changed, and then releasing the sewing threads in the accumulated thread amounts, thus forming beautiful stitches of stitching decoration. The thread feeding device is also capable of simplifying the mechanism thereof and eliminating the need for a correction or adjustment or the like as a preparatory operation.

Solution to Problem

To this end, a thread feeding device of a decorative stitch sewing machine in accordance with the present invention is a thread feeding device of a decorative stitch sewing machine configured to feed a fabric by a fabric feeding device for each stitch and to supply a plurality of sewing threads, including a needle thread, an upper looper thread, and a lower looper thread to a stitch forming device which includes at least one needle, an upper looper, and a lower looper that form a stitch on the fabric so as to interloop the upper looper thread and the lower looper thread, which are looped to the needle thread thereby to form hemstitches on a hem of the fabric, and configured to perform decorative stitching according to a stitching decoration pattern by changing a position of the stitch looping point of the needle thread, the upper looper thread and the lower looper thread, the thread feeding device comprising:

(a) an upstream gripper, which grips a sewing thread in a thread path of the sewing thread fed from a spool, which is closed at the time of forming a stitch by the stitch forming device, and which is opened at a time of feeding the fabric by the fabric feeding device, and a downstream gripper, which grips the sewing thread introduced from the upstream gripper, which is opened to draw out the sewing thread by the stitch forming device at the time of forming a stitch, and which is closed at the time of feeding the fabric;

(b) an upstream thread accumulating element and a downstream thread accumulating element, which extend between the upstream gripper and the downstream gripper and which measure a thread accumulation amount of a predetermined length of each of the needle thread, the upper looper thread and the lower looper thread; and (c) a thread accumulator which has a needle thread accumulation amount control element, an upper looper thread accumulation amount control element, and a lower looper thread accumulation amount control element, each of which extends between the upstream thread accumulating element and the downstream thread accumulating element, and adjusts in an increasable and decreasable manner the sewing thread amount of each of the needle thread, the upper looper thread and the lower looper thread required for sewing one stitch within the range of the thread accumulation amount of the predetermined length at the time of feeding the fabric, and which releases the threads to the stitch forming device at the time of forming a stitch, the thread accumulator being driven in synchronization with the fabric feeding device and the stitch forming device;

a thread feed drive mechanism which drives each of the needle thread accumulation amount control element, the upper looper thread accumulation amount control element, and the lower looper thread accumulation amount control element of the thread accumulator, and a thread feed control unit having a program which drives the needle thread accumulation amount control element, the upper looper thread accumulation amount control element, and the lower looper thread accumulation amount control element of the thread accumulator through an intermediary of the thread feed drive mechanism for each stitch to feed each of the needle thread, the upper looper thread and the lower looper thread in an increasable and decreasable manner such that a thread feed expression given below is satisfied, and which increases or decreases the needle thread, the upper looper thread and the lower looper thread within a range of a total thread feeding amount that is maintained constant, including a fabric feeding amount, a fabric thickness and an overlocking width, so as to change the position of the stitch looping point of the needle thread, the upper looper thread and the lower looper thread thereby to control decorative stitching according to the stitching decoration pattern:

$$\begin{aligned} L &= L_N + L_U + L_D \\ &= [p + 2t + Ek_{PN}] + [2Ek_{PU} + t] + [2Ek_{PD} + t] \\ &= E(k_{PN} + 2k_{PU} + 2k_{PD}) + 4t + p \end{aligned}$$

(where L: total thread feeding amount; $L_N$: needle thread feeding amount; $L_U$: upper looper thread feeding amount; $L_D$: lower looper thread feeding amount; p: fabric feeding amount; t: fabric thickness; E: overlocking width; $k_{PN}$: needle thread coefficient related to fabric feeding amount; $k_{PU}$ upper looper thread coefficient related to fabric feed amount; and $k_{PD}$: lower looper thread coefficient related to fabric feed amount)

According to the thread feeding device of a decorative stitch sewing machine, the program includes:

a thread accumulation step of accumulating, by the thread accumulator each of the needle thread, the upper looper thread, and the lower looper thread in a sewing thread amount required for sewing one stitch in a fabric feeding step of one stitch immediately before a stitch forming step of one stitch; and a thread release step of releasing the needle thread, the upper looper thread, and the lower looper thread to the needle, the upper looper, and the lower looper, respectively, of the stitch forming device in the stitch forming step of one stitch immediately after the fabric feeding step for the one stitch.

According to the thread feeding device of a decorative stitch sewing machine, in the thread accumulation step, the total thread feeding amount of the threads is increased or decreased according to a fabric feeding amount, a fabric thickness, an overlocking width, and a shape of the decoration stitching pattern, and then allocated to each of the needle thread, the upper looper thread, and the lower looper thread.

According to the thread feeding device of a decorative stitch sewing machine, the program includes:

a step of determining the sewing thread amount of each of the needle thread, the upper looper thread, and the lower looper thread according to relative displacement positions of the upstream thread accumulating element and the downstream thread accumulating element in relation to the needle thread accumulation amount control element, the upper looper thread accumulation amount control element and the lower looper thread accumulation amount control element in the thread accumulator.

According to the thread feeding device of a decorative stitch sewing machine, the thread accumulation step of accumulating, by the thread accumulator, the sewing thread amount of each of a needle thread, an upper looper thread, and a lower looper thread that is required for sewing one stitch in the fabric feeding step for one stitch immediately before the stitch forming step of one stitch includes:

a thread accumulation amount measurement step of moving the upstream thread accumulating element and the downstream thread accumulating element to measure the thread accumulation amount of the predetermined length of each of the needle thread, the upper looper thread, and the lower looper thread;

a thread accumulation amount calculation step of increasing or decreasing the total thread feeding amount of the needle thread, the upper looper thread, and the lower looper thread according to a fabric feeding amount, a fabric thickness, an overlocking width, and the shape of the stitching decoration pattern, and then allocating a calculation result to each of the needle thread, the upper looper thread, and the lower looper thread; and a thread accumulation amount adjustment step of relatively moving the needle thread accumulation amount control element, the upper looper thread accumulation amount control element, and the lower looper thread accumulation amount control element with respect to an upstream thread accumulating element and a downstream thread accumulating element according to the amount of thread allocated to each of the needle thread, the upper looper thread, and the lower looper thread thereby to adjust, in an increasable or decreasable manner, the sewing thread amount of each of the needle thread, the upper looper thread, and the lower looper thread required for sewing one stitch.

According to the thread feeding device of a decorative stitch sewing machine, the thread accumulation amount adjustment step is carried out before the thread accumulation amount measurement step for the next one stitch is started, after the completion of the thread release step.

According to the thread feeding device of a decorative stitch sewing machine, the thread feed drive mechanism is composed of a pulse motor controlled by the thread feed control unit, and a rack pinion, which performs motion conversion to convert a rotation of the pulse motor into the displacements of the needle thread accumulation amount control element, the upper looper thread accumulation amount control element, and the lower looper thread accumulation amount control element of the thread accumulator, and is adapted to feed and drive each of the needle thread, the upper looper thread, and the lower looper thread.

The thread feeding device of a decorative stitch sewing machine is provided with a thread accumulating element actuation detection device, which detects a moment of closure of the downstream gripper, applies the data of the detection to the thread feed control unit, and carries out the thread accumulation amount adjustment step before the thread accumulation amount measurement step for the next stitch is started after the completion of the thread release step.

The thread feeding device of a decorative stitch sewing machine is provided with a fabric feeding amount detection device, which detects a fabric feeding amount set by the fabric feeding device that adjusts the fabric feeding amount of a fabric, and applies the data of the detection to the thread feed control unit.

The thread feeding device of a decorative stitch sewing machine is provided with an overlocking width detection device, which detects an overlocking width set by an overlocking width adjustment unit that adjusts an overlocking width, and applies the data of the detection to the thread feed control unit.

The thread feeding device of a decorative stitch sewing machine is provided with a fabric thickness detection device, which detects a fabric thickness, and applies the data of the detection to the thread feed control unit.

Advantageous Effect of the Invention

The thread feeding device of a decorative stitch sewing machine in accordance with the present invention provides the advantages described below. Decorative stitching in multiple types of stitching decoration patterns can be achieved by supplying and accumulating in advance a plurality of sewing threads, including a needle thread, an upper looper thread and a lower looper thread, in sewing thread amounts necessary for sewing each stitch such that the position of a stitch looping point is changed, and then releasing the sewing threads in the accumulated thread amounts, thus forming beautiful stitches of stitching decoration. In addition, the need for a correction or adjustment or the like as a preparatory operation can be eliminated.

DESCRIPTION OF EMBODIMENTS

The following will describe a preferred embodiment of the thread feeding device of a decorative stitch sewing machine in accordance with the present invention with reference to the accompanying drawings.

In the following description, the terms indicating the directions such as top, bottom, vertical, left, right, horizontal, front, back, frontal and rear will be used on the basis of the direction observed from a sewing operator side, referring to FIG. 1 which illustrates the decorative stitch sewing machine in accordance with the present invention.

Figure 1:
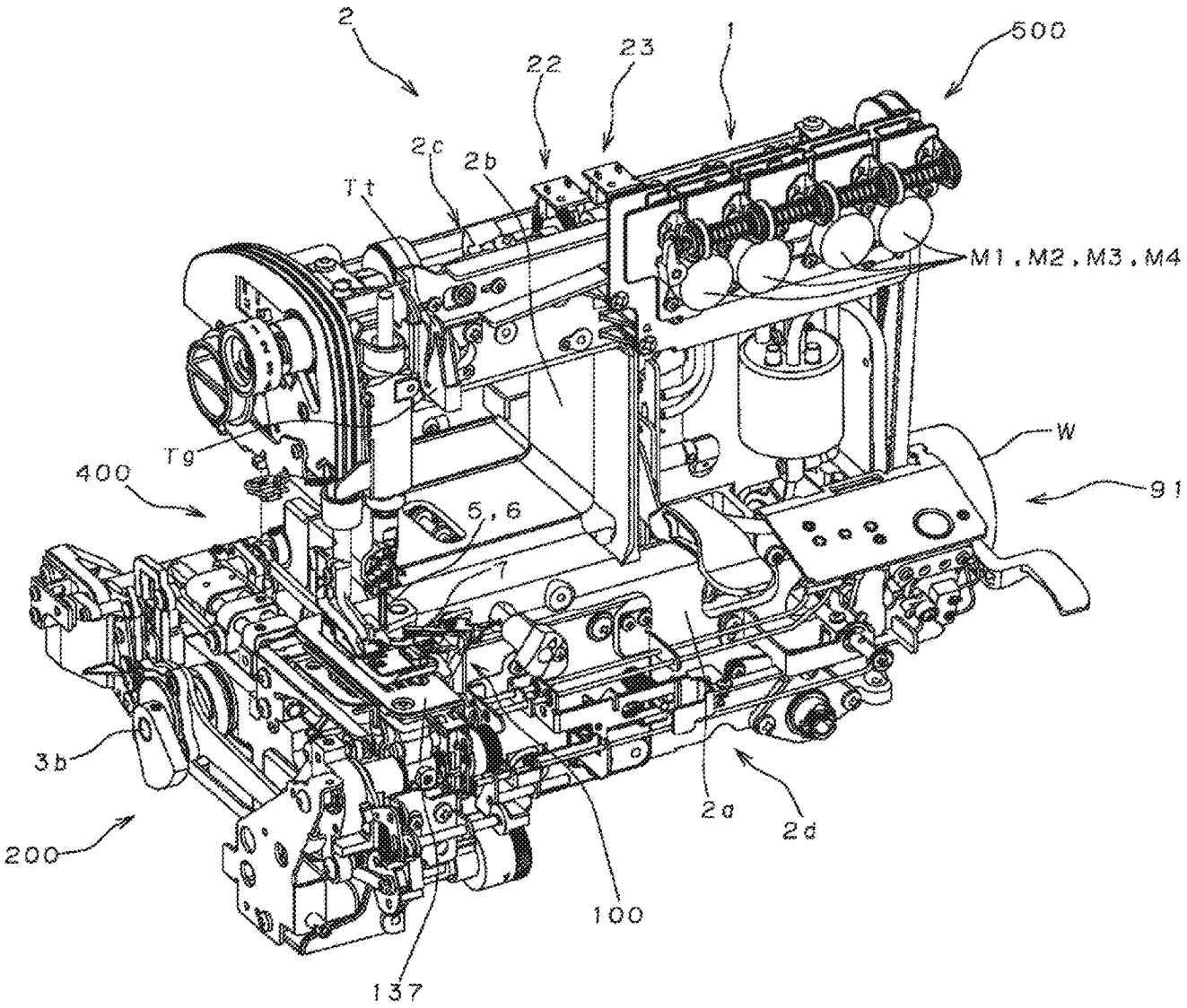
FIG. 1 is an overall perspective view of a decorative stitch sewing machine, to which a thread feeding device in accordance with the present invention is applied, as observed from the front (from the front surface)
Figure 2:
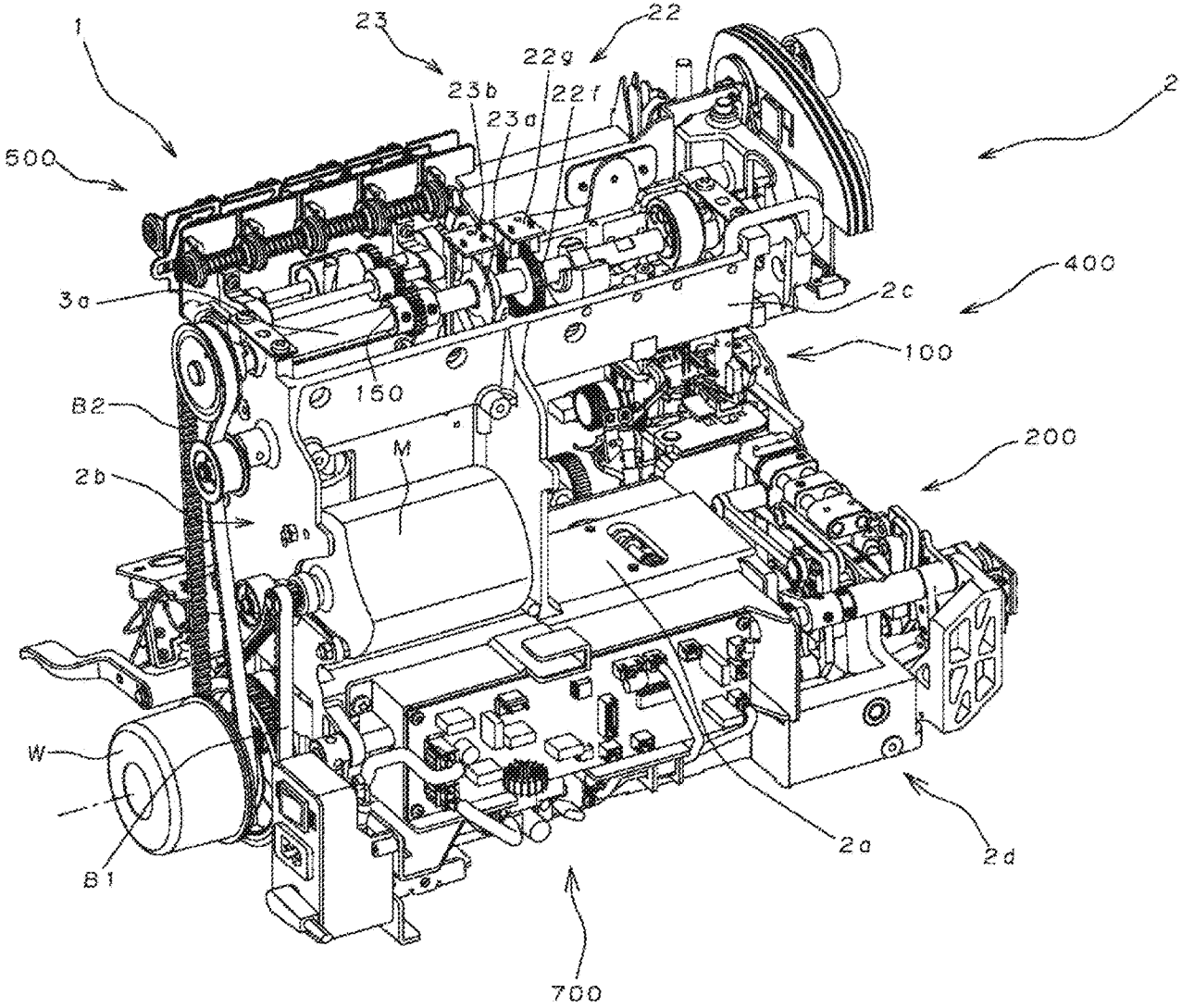
FIG. 2 is an overall perspective view of the decorative stitch sewing machine, to which the thread feeding device in accordance with the present invention is applied, as observed from the back (from the rear surface)
Figure 3:
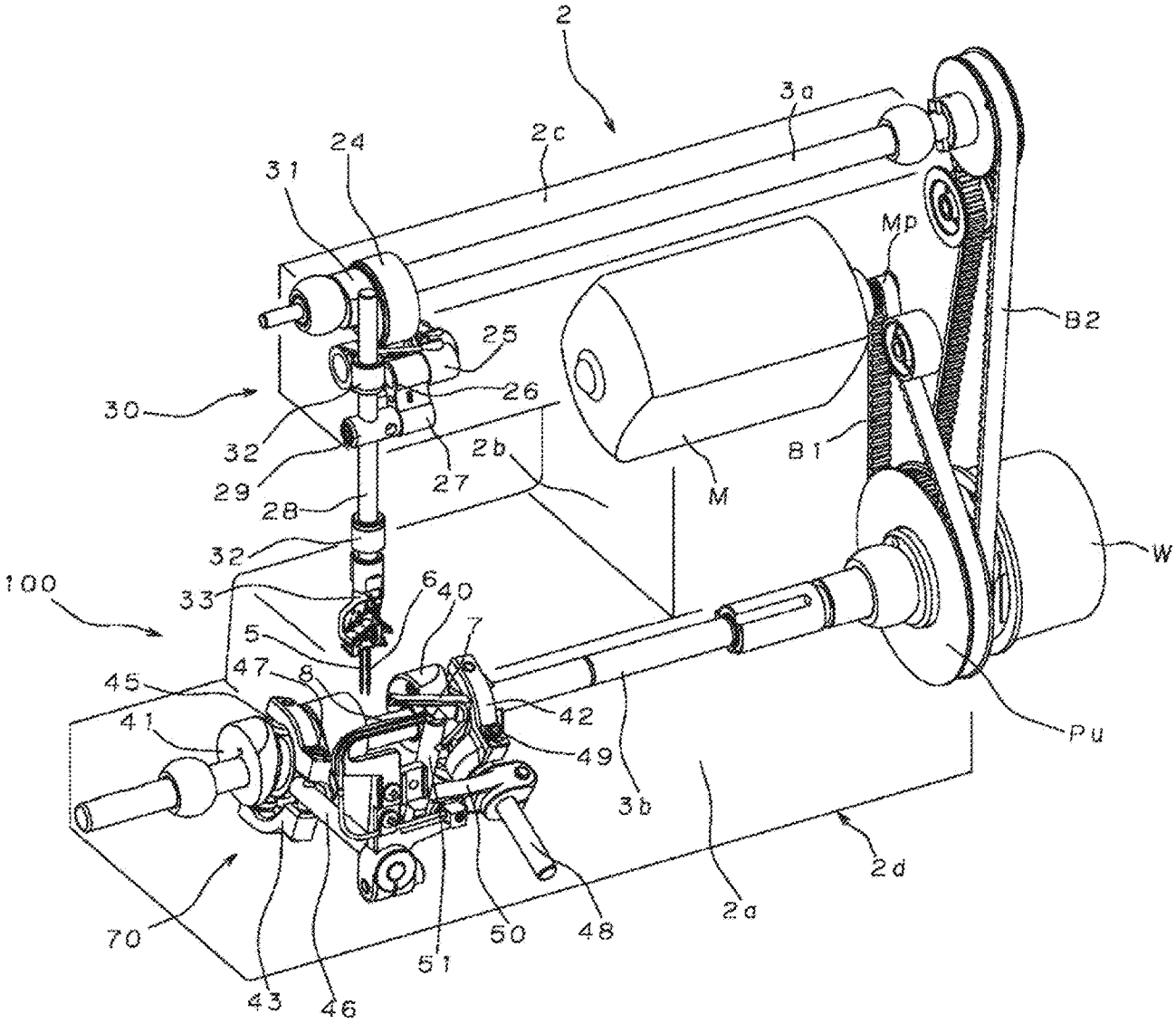
FIG. 3 is a perspective view of a stitch forming device in the decorative stitch sewing machine, to which the thread feeding device in accordance with the present invention is applied.
Figure 4:
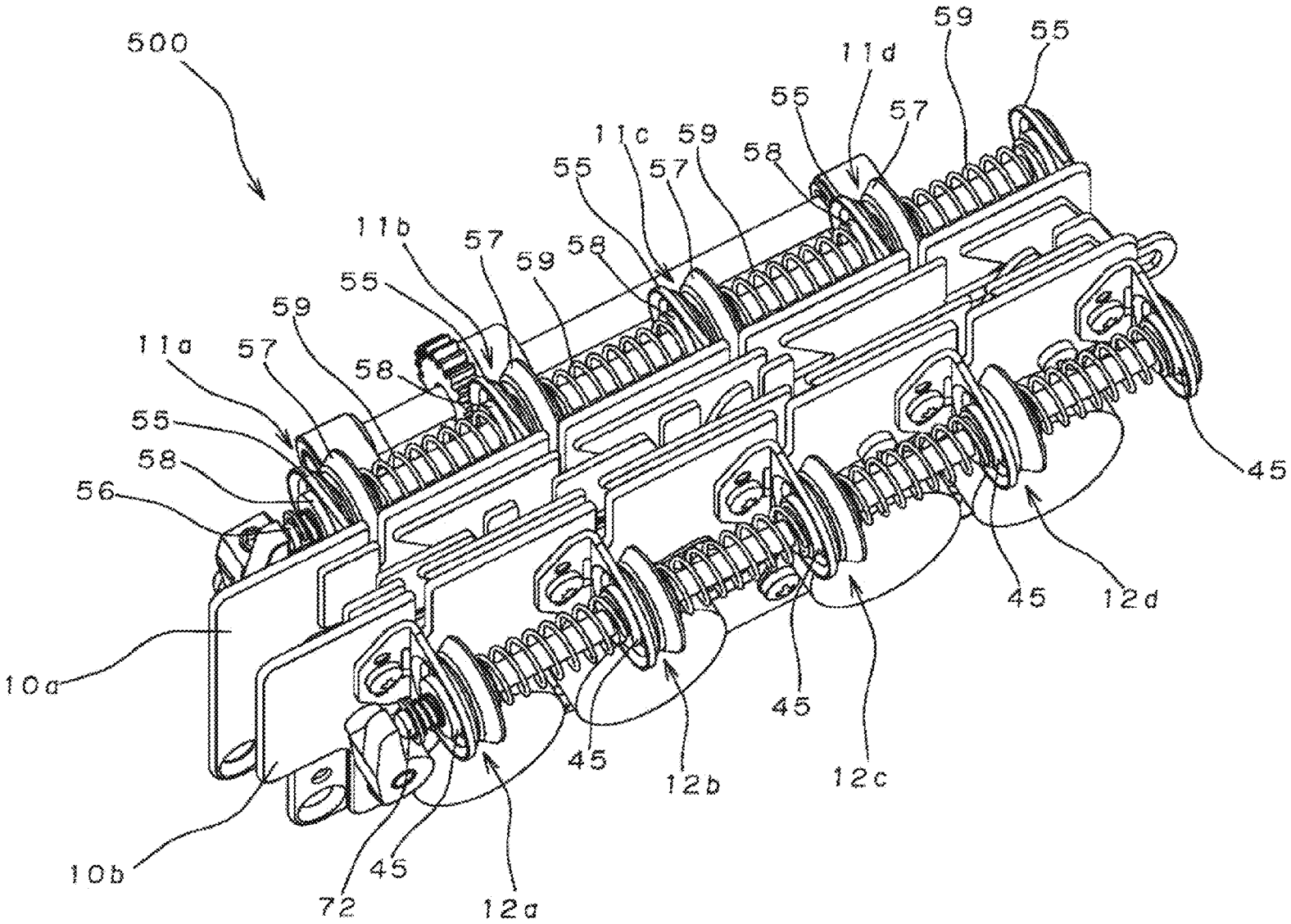
FIG. 4 is a perspective view of a thread accumulator applied to the thread feeding device in accordance with the present invention, as observed from the front.
Figure 5:
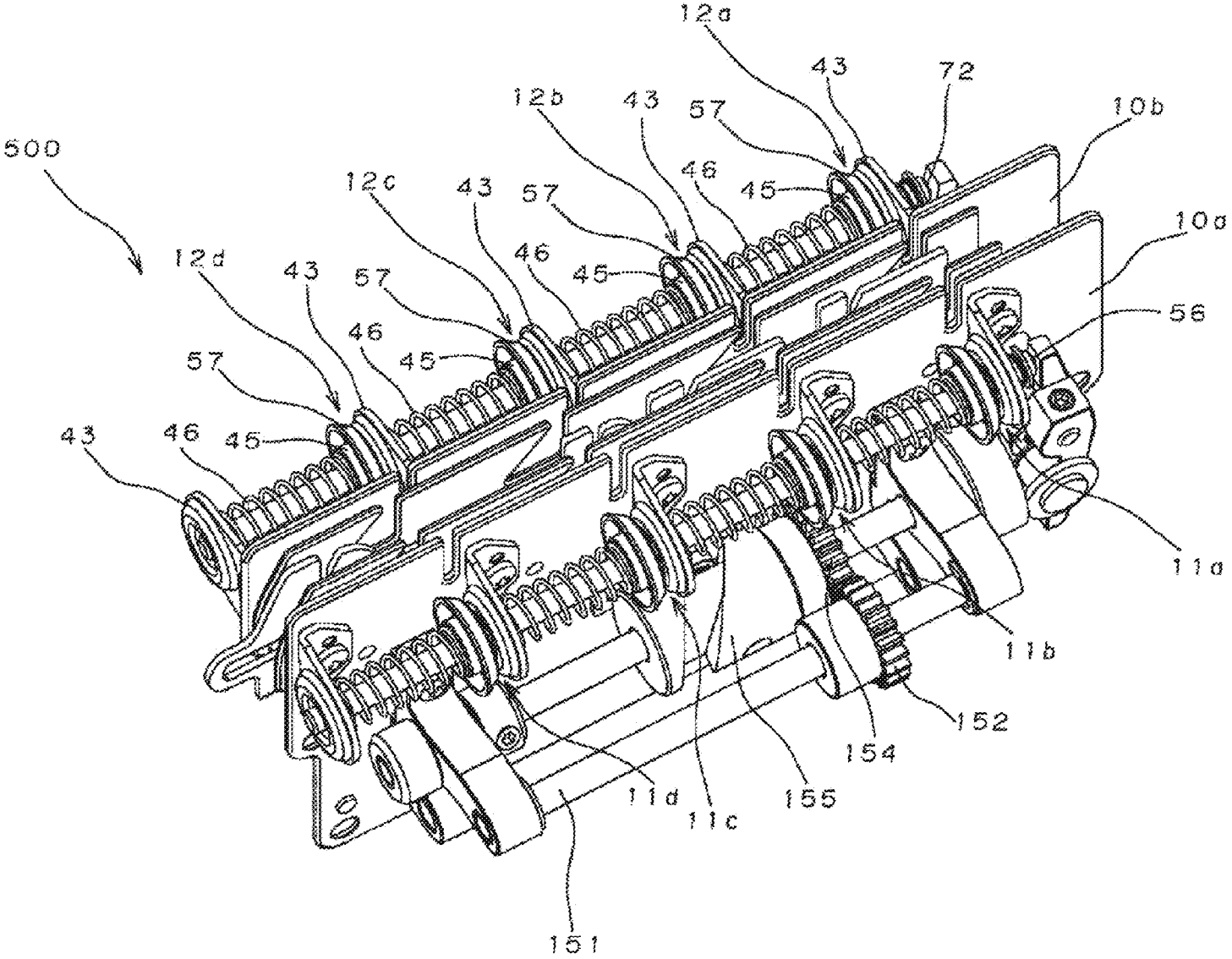
FIG. 5 is a perspective view of the thread accumulator applied to the thread feeding device in accordance with the present invention, as observed from the back.
Figure 6:
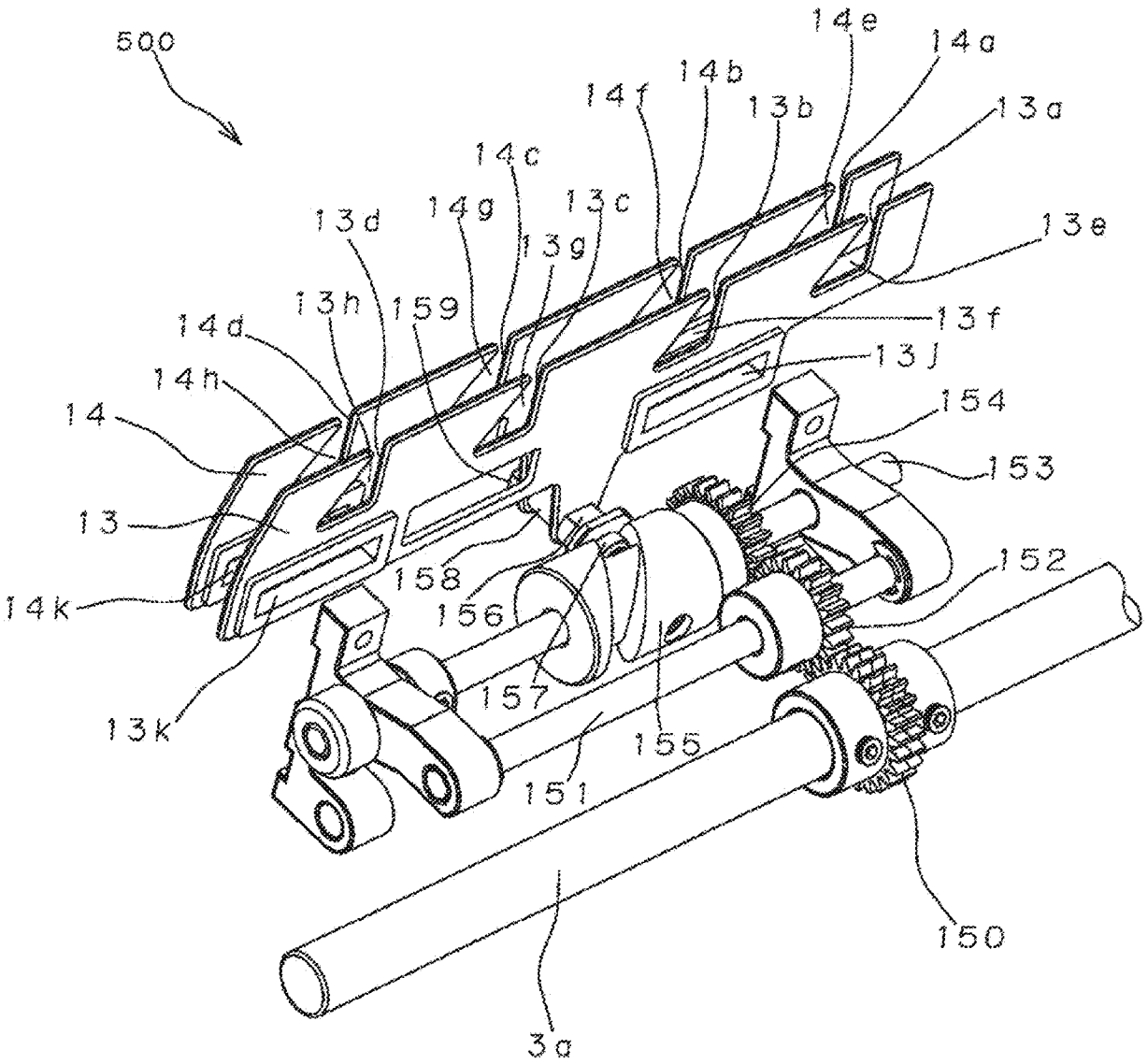
FIG. 6 is a partial perspective view of the thread accumulator applied to the thread feeding device in accordance with the present invention.
Figure 7:
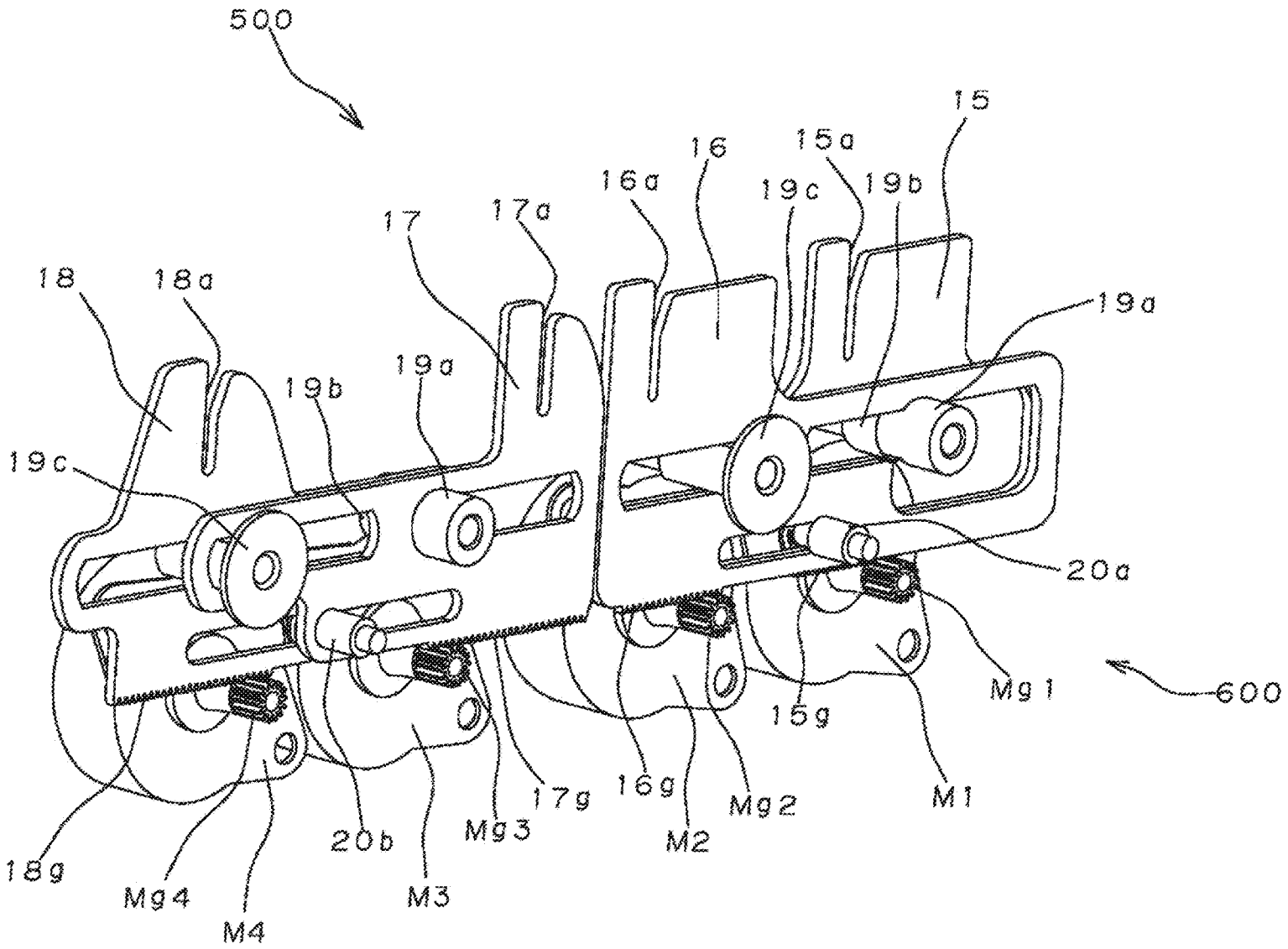
FIG. 7 is another partial perspective view of the thread accumulator applied to the thread feeding device in accordance with the present invention.
Figure 8:
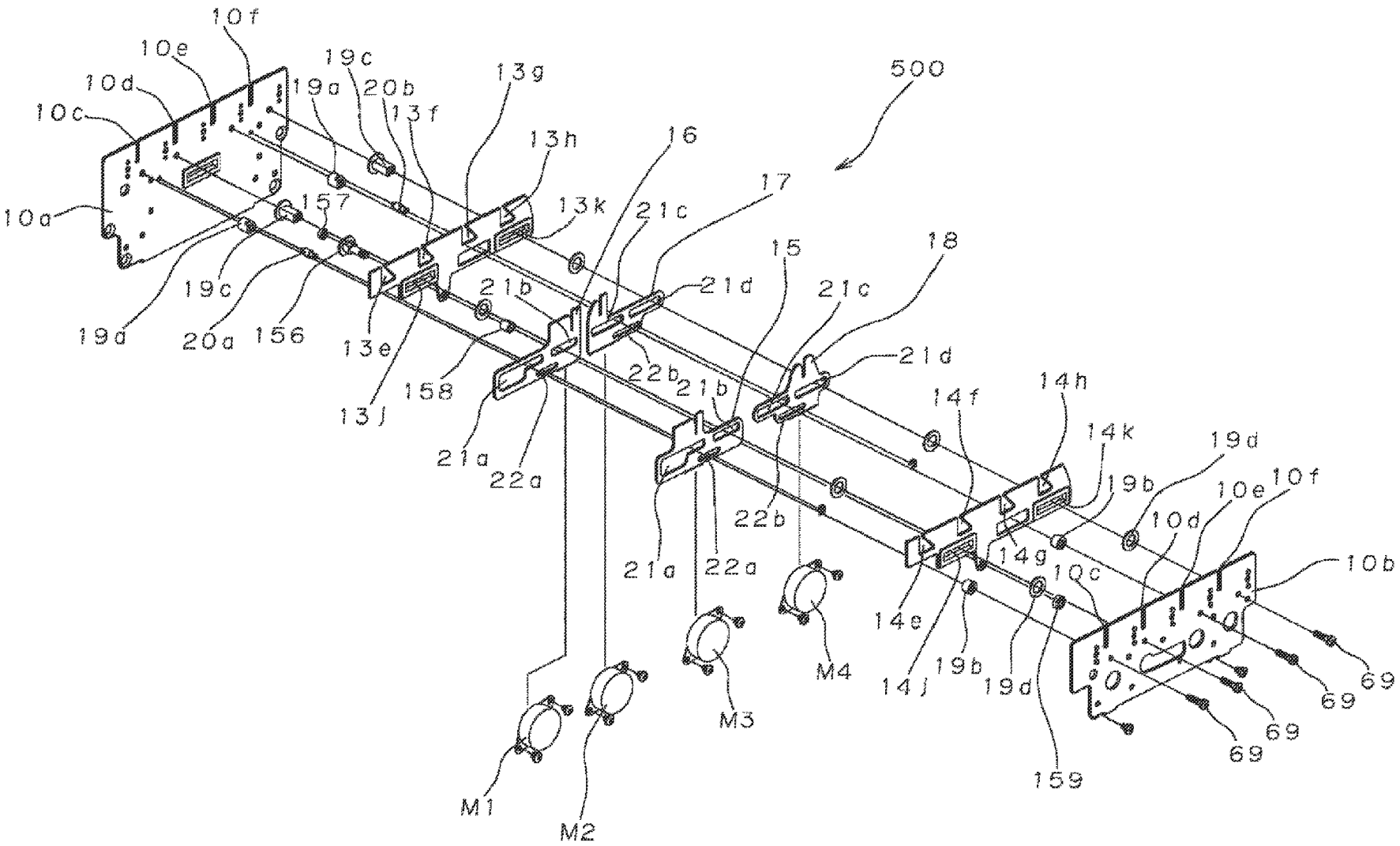
FIG. 8 is a developed perspective view of the thread accumulator applied to the thread feeding device in accordance with the present invention.

Basic Structure:

As illustrated in FIG. 1 to FIG. 3, a decorative stitch sewing machine 2 in which a thread feeding device 1 in accordance with the present invention is incorporated is formed of a machine frame 2*d* composed of a bed 2*a*, a leg 2*b*, and an arm 2*c*. The arm 2*c* and the bed 2*a* bear an upper and a lower shafts 3*a* and 3*b*, respectively.

A flywheel W is fixed to the lower shaft 3*b* and is rotationally driven by a sewing motor M through a timing belt B1. The upper shaft 3*a* is rotationally driven through a timing belt B2 from a pulley Pu fixed to the lower shaft 3*b* and driven by the sewing motor M.

The decorative stitch sewing machine 2 formed of the machine frame 2*d* composed of the bed 2*a*, the leg 2*b*, and the arm 2*c* is constructed of a stitch forming device 100, a fabric feeding device 200, a fabric cutting device 300, a fabric pressing device 400, a thread accumulator 500, a thread feed drive mechanism 600, a thread feed control unit 700, and other mechanisms or devices. These will be described in detail below in order.

Stitch Forming Device

Figure 12:
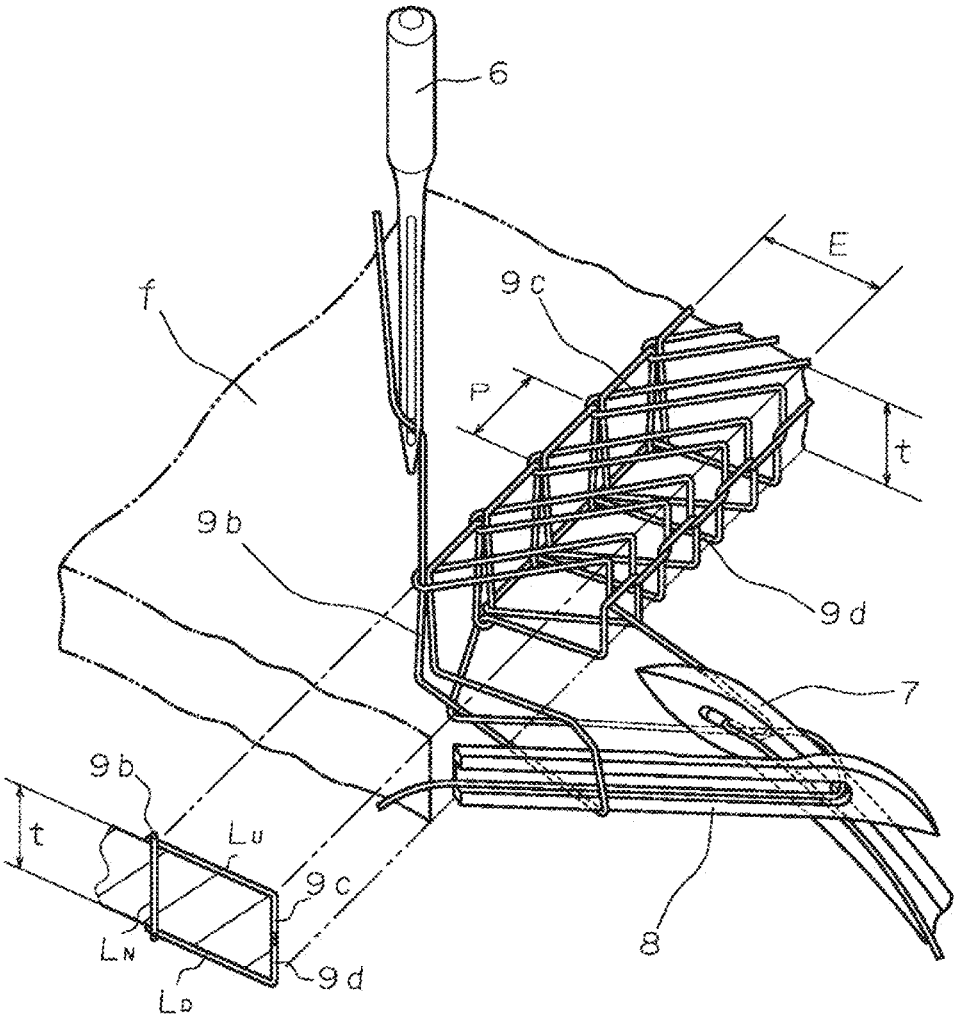
FIG. 12 is an explanatory diagram illustrating the stitches of 1-needle, 3-thread overlock stitching performed by the thread feeding device of a decorative stitch sewing machine in accordance with the present invention.

As illustrated in FIG. 3, the stitch forming device 100 has a function for forming stitches on a fabric f (FIG. 12) together with other mechanisms or devices, and includes a needle drive mechanism 30 for a left needle 5 and a right needle 6, and a looper drive mechanism 70 for an upper looper 7 and a lower looper 8. In the stitch forming device 100, the needle drive mechanism 30 is actuated in synchronization with the rotational motion of the upper shaft 3*a* driven by the sewing motor M, and the looper drive mechanism 70 is actuated in synchronization with the rotational motion of the lower shaft 3*b*. The needles 5, 6 and the upper looper 7 and the lower looper 8 are driven to form a stitch.

More specifically, in the needle drive mechanism 30, the upper shaft 3*a* is provided with a needle drive eccentric cam 31, a cam follower 24 is rotatably fitted in the needle drive eccentric cam 31, a connection hole provided in the cam follower 24 is pivotally attached to one end of a lever 25. A middle point of the lever 25 is supported by the machine frame 2*d* at a fixing point, and the other end of the lever is pivotally attached to one end of a connection link 27 by a connection pin 26. The other end of the connection link 27 is pivotally attached to a needle bar fixing and mounting section 29 fixed to a needle bar 28. The needle bar 28 is slidably installed to a needle bar bearing 32 fixed to the machine frame 2*d*. The needle bar 28 is provided with a needle holder 33, and the left needle 5 and the right needle 6 are fixed to the needle holder 33. Thus, in the needle drive mechanism 30, the rotational motion of the upper shaft 3*a* is converted into the linear motions of the left needle 5 and the right needle 6. More specifically, as the upper shaft 3*a* driven by the sewing motor M rotates once, the left needle 5 and the right needle 6 each performs one reciprocating linear motion in the vertical direction.

In the looper drive mechanism 70, an upper looper drive circumferential tilt cam 40 and a lower looper drive circumferential tilt cam 41 are fixed to the lower shaft 3*b*, and a roller, which is a cam follower attached to an upper looper drive fork 42 and a lower looper drive fork 43, is engaged with the upper looper drive circumferential tilt cam 40 and the lower looper drive circumferential tilt cam 41. The lower looper drive fork 43 is pivotally attached to a lower looper drive shaft by a pin 47. The lower looper 8 is fixed to the lower looper drive shaft. The upper looper drive fork 42 is pivotally attached to an upper looper drive shaft 48 by a pin 49. One end of an upper looper drive arm 50 is fixed to the upper looper drive shaft 48, and an upper looper mounting shaft 51 is pivotally attached to the other end of the upper looper drive arm 50. The upper looper mounting shaft 51 is slidably supported by a pivot rotatably attached to the machine frame 2*d*. The upper looper 7 is fixed to the upper end of the upper looper mounting shaft 51.

Fabric Feeding Device

Figure 9:
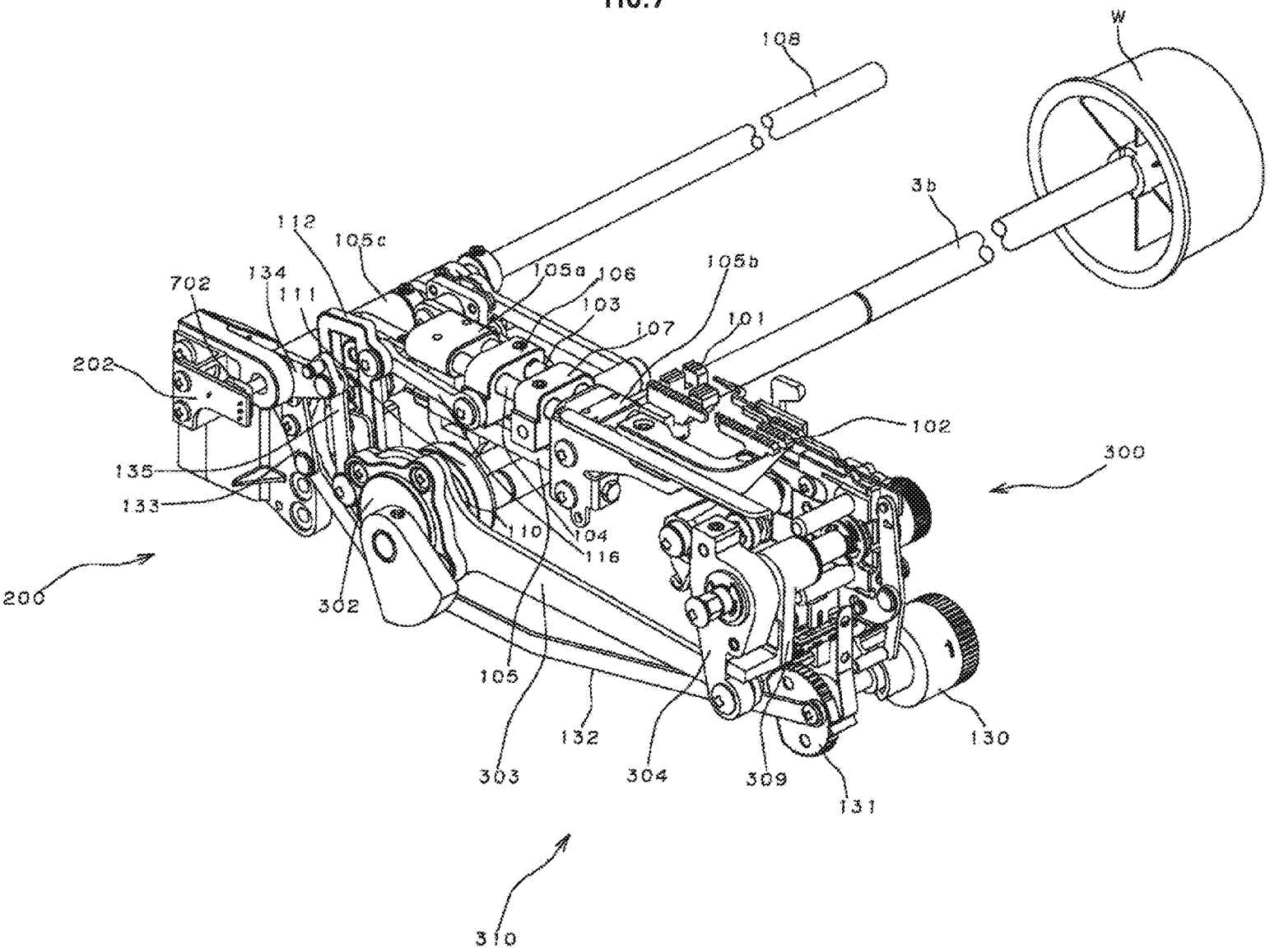
FIG. 9 is a perspective view of a fabric feeding device and a fabric cutting device in the decorative stitch sewing machine, to which the thread feeding device in accordance with the present invention is applied.

The fabric feeding device 200 has a function for feeding, i.e. advancing, a fabric f, which is to be sewn, when the left needle 5 and the right needle 6 come out of the fabric f, i.e. immediately after a stitch is formed by the left needle 5, the right needle 6, the upper looper 7, and the lower looper 8. As illustrated in FIG. 9, the fabric feeding device has a function for advancing the fabric f by driving a feed dog. The fabric feeding device is actuated in synchronization with the rotational motion of the lower shaft 3*b*. The fabric feeding amount can be changed through an adjustment arm 134 by operating a stitch length adjustment dial 130 of a feeding amount adjustment mechanism. A fabric feeding amount import volume shaft is fixedly attached to the adjustment arm 134, coinciding with the center of rotation of the adjustment arm 134. The fabric feeding amount import volume shaft rotates as the adjustment arm 134 rotates, thus actuating a feeding amount detection device 702 provided on a substrate 202 and sending a signal to the thread feed control unit 700.

More specifically, in the fabric feeding device 200, a horizontal feeding cam 110 is fixed to the lower shaft 3*b*. In the fabric feeding device 200, a main feed dog 101 is fixed to a main feed dog mounting shaft 103 such that the main feed dog 101 moves forward and backward in a fabric feeding direction, and the main feed dog mounting shaft 103 is slidably supported by support sections 105*a* and 105*b* of a feed base 105. A main feed drive body 106 is fitted on these main feed dog mounting shafts 103, 104, the main feed dog mounting shaft 103 being fixed to the main feed drive body 106. The feed base 105 that supports these members has a cylindrical boss section 105*c* and is supported by a base shaft 108 through the cylindrical boss section 105*c*. The base shaft 108 is pivotally supported by the machine frame 2*d*.

Meanwhile, a horizontal feed rod 111 is fitted to the horizontal feeding cam 110 fixed to the lower shaft 3*b*. One end of the horizontal feed rod 111 is connected to one end of a main feed drive arm 112, and a main feed slide rod is held by two stopper plates and slidably supported in a rectangular hole in the main feed drive am 112. The main feed slide rod is supported by a rocking shaft at a portion near the cylindrical boss section 105*c* of the feed base 105. The other end of the main feed drive arm 112 is connected to the main feed drive body 106 fixed to the main feed dog mounting shaft 103 through a main feed link 116.

The fabric feeding device 200 configured as described above is provided with the stitch length adjustment dial 130 to adjust main feed. The stitch length adjustment dial 130 is fixed to a substantially semicircular plate 131 through a feed dial shaft, and the substantially semicircular plate 131 is connected to the adjustment arm 134 through a link 132 and an adjustment plate 133. The adjustment arm 134 is pivotally supported by the base shaft 108, and the adjustment arm 134 is connected to one end of the main feed drive arm 112 through an adjustment link 135.

The main feed dog 101 of the fabric feeding device 200 described above can move, by an appropriate fabric feeding amount, the fabric f held against a needle plate 137 (FIG. 1) by a fabric presser 450 fixed to the distal end of a pressing bar 451 (FIG. 11) slidably attached to the machine frame 2*d*.

Figure 10:
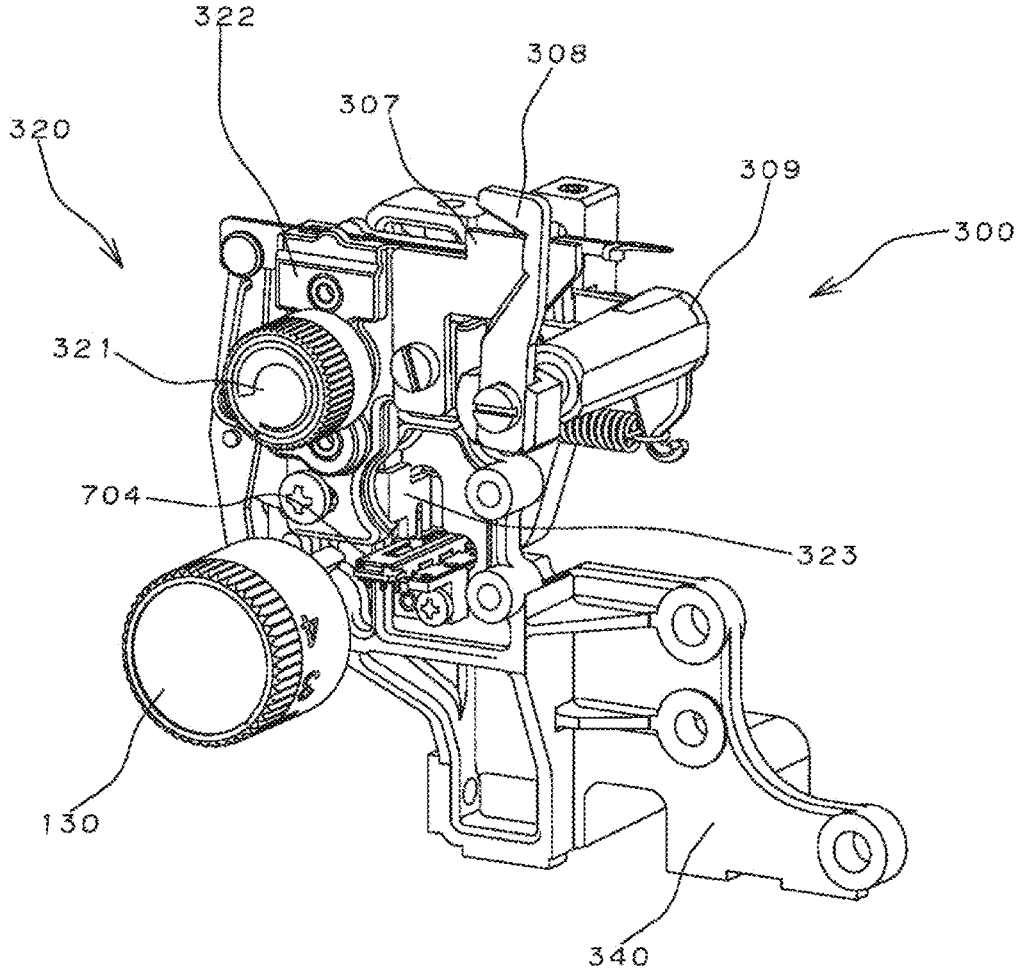
FIG. 10 is a perspective view of the fabric cutting device in the decorative stitch sewing machine, to which the thread feeding device in accordance with the present invention is applied.

Fabric Cutting Device:

The fabric cutting device 300 is actuated by the sewing motor M in synchronization with the rotational motion of the lower shaft 3*b*, as illustrated in FIG. 9 and FIG. 10.

More specifically, the fabric cutting device 300 has a function for trimming the hem of a fabric immediately before sewing, and is composed of a knife drive mechanism 310 that includes a link 303 swung by a cam 302 which is fixed to the lower shaft 3*b* and which rotates, a knife drive arm 304 swung by the link 303, a movable knife 308 which is attached to the knife drive arm 304 and which vertically moves, being pressed against a fixed knife 307, as an L-shaped arm 309 is swung by the knife drive arm 304, and an overlocking width adjustment base 322 to which the fixed knife 307 is attached.

An overlocking width adjustment unit 320 is provided, which changes the fabric cutting width (knife cutting width) for trimming the hem of a fabric by the knife drive mechanism 310 immediately before sewing. The overlocking width adjustment unit 320 has an overlocking width adjustment dial 321. The overlocking width adjustment base 322 has a tapped hole in which a dial shaft screw of the overlocking width adjustment dial 321 is screwed, and enables the transverse position of the overlocking width adjustment base 322 to be adjusted along a guide pin according to the rotation of the overlocking width adjustment dial 321. Thus, the overlocking width is adjusted.

The fixed knife 307 is moved in the transverse direction to freely change a cutting width E of the fabric f. The fixed knife 307 is attached to the overlocking width adjustment base 322. A knife overlocking width unit base 340 is attached to the bed 2*a*. An overlocking width detection device 704 is fixed to the knife overlocking width unit base 340.

An actuation arm 323 is attached to the overlocking width adjustment base 322, actuates the overlocking width detection device 704 fixed to the knife overlocking width unit base 340, and sends the signal to the thread feed control unit 700.

Figure 11:
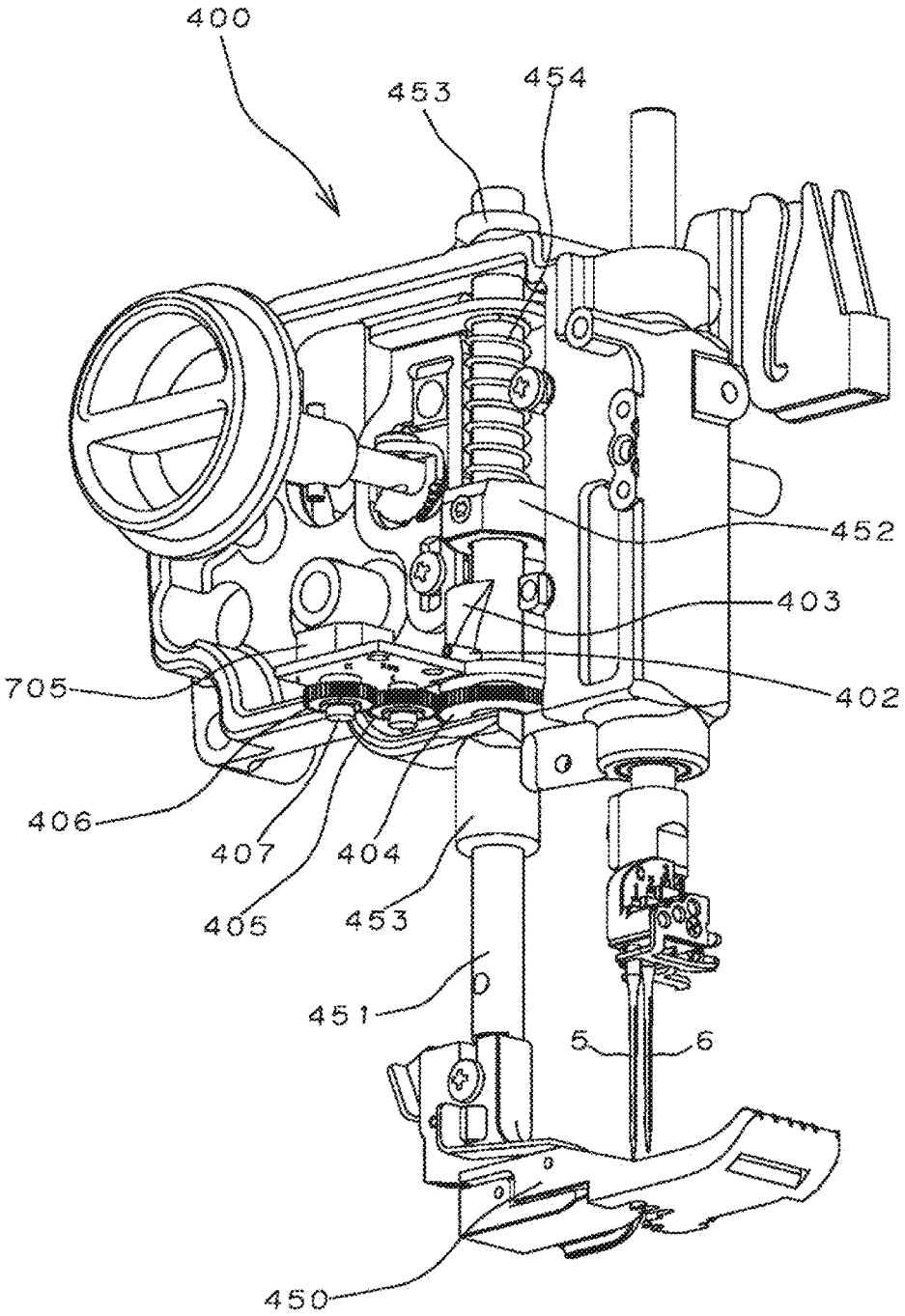
FIG. 11 is a perspective view of a fabric pressing device in the decorative stitch sewing machine, to which the thread feeding device in accordance with the present invention is applied.

Fabric Pressing Device:

The fabric pressing device 400 includes the pressing bar 451, the fabric presser 450 provided at the distal end of a pressing bar 451, a pressing bar holder 452 which supports the pressing bar 451 in a vertically slidable and non-rotatable manner and which is provided in the machine fame 2*d*, a pair of bearings 453 pivotally supporting the pressing bar 451, and a spring 454 which presses the pressing bar holder 452 and the fabric presser 450 against the needle plate 137. In other words, as illustrated in FIG. 11, the fabric pressing device 400 has a function for pressing, by the fabric presser 450, the fabric f against the needle plate 137 when a stitch is formed by the stitch forming device 100 and when the fabric is fed by the fabric feeding device 200. According to the thickness of the fabric f, the pressing bar 451 vertically moves through the fabric presser 450, a fabric thickness detection pin 402 implanted in the pressing bar 451 rotates a fabric thickness detection cam 403, the rotational motion of a fabric thickness detection cam gear 404 attached to the fabric thickness detection cam 403 causes a fabric thickness detection device gear 406 to rotationally move through a gear 405 thereby to actuate a fabric thickness detection device 705, and the signal is sent to the thread feed control unit 700.

Thread Accumulator:

As illustrated in FIG. 4 to FIG. 8, the thread accumulator 500 which is applied to the thread feeding device 1 of the present invention and which has the mechanical characteristics and the electronic control characteristics of the present invention is provided in a thread path of sewing threads which are fed from a spool Bo (FIGS. 13A and 13B) and released to the left needle 5, the right needle 6, the upper looper 7, and the lower looper 8 of the stitch forming device 100, i.e. the thread path of a left needle thread 9*a*, a right needle thread 9*b*, an upper looper thread 9*c*, and a lower looper thread 9*d*. The thread accumulator 500 has a function for temporarily keeping to accumulate the sewing threads fed from the spool Bo when feeding the fabric f and releasing the accumulated sewing threads when forming a stitch.

In the thread accumulator 500, a pair of thread feeding unit boards 10*a* and 1*b* are provided, which are fixed to the machine frame 2*d* and which extend in the transverse direction, being placed apart from each other. Each of the pair of thread feeding unit boards 10*a* and 10*b* is provided with a left needle thread slit 10*c*, a right needle thread slit 10*d*, an upper looper thread slit 10*e*, and a lower looper thread slit 10*f*, which indicate the fixed passing points of the sewing threads, i.e. the reference points of the thread accumulation amounts of the thread accumulator 500. The pair of thread feeding unit boards 10*a* and 10*b* are provided with the following mechanical elements.

(a) a left needle thread upstream gripper 11*a*, a right needle thread upstream gripper 11*b*, an upper looper thread upstream gripper 11*c*, and a lower looper thread upstream gripper 11*d*, which grip the sewing threads, namely, the left needle thread 9*a*, the right needle thread 9*b*, the upper looper thread 9*c*, and the lower looper thread 9*d* individually fed from the spool Bo, in the thread path, which is closed when a stitch is formed by the stitch forming device 100 and opened when the fabric f is fed by the fabric feeding device 200, and a left needle thread downstream gripper 12*a*, a right needle thread downstream gripper 12*b*, an upper looper thread downstream gripper 12*c*, and a lower looper thread downstream gripper 12*d*, which grip the sewing threads introduced from the upstream grippers 11*a* to 11*d*, which are opened to draw out the sewing threads by the stitch forming device 100 when forming a stitch, and which are closed when the fabric f is fed;

(b) upstream thread accumulating elements 13, namely, a left needle thread upstream thread accumulating element 13*a*, a right needle thread upstream thread accumulating element 13*b*, an upper looper thread upstream thread accumulating element 13*c*, a lower looper thread upstream thread accumulating element 13*d*, which extend between the pair of thread feeding unit boards 10 and 10*b* between the upstream grippers 11*a* to 11*d* and the downstream grippers 12*a* to 12*d* and which measure the thread accumulation amount of a predetermined length of each of the sewing threads, namely, the left needle thread 9*a*, the right needle thread 9*b*, the upper looper thread 9*c*, and the lower looper thread 9*d*, and downstream thread accumulating elements 14, namely, a left needle thread downstream thread accumulating element 14*a*, a right needle thread downstream thread accumulating element 14*b*, an upper looper thread downstream thread accumulating element 14*c*, and a lower looper thread downstream thread accumulating element 14*d*; and (c) the thread accumulator 500 having a left needle thread accumulation amount control element 15, aright needle thread accumulation amount control element 16, an upper looper thread accumulation amount control element 17, and a lower looper thread accumulation amount control element 18, which extend between the upstream thread accumulating elements 13*a* to 13*d* and the downstream thread accumulating elements 14*a* to 14*d*, which adjust the sewing thread amounts of the left needle thread 9*a*, the right needle thread 9*b*, the upper looper thread 9*c* and the lower looper thread 9*d* that are required for sewing one stitch in an increasable and decreasable manner within the range of a thread accumulation amount of a predetermined length when feeding the fabric f, the sewing threads being released by the stitch forming device when forming a stitch, the thread accumulator 500 being driven in synchronization with the fabric feeding device 200 and the stitch forming device 100.

The mechanical elements will be described in further detail. The upstream grippers 11*a* to 11*d* have an upstream gripping shaft 56 pivotally attached to five upstream gripper support plates 55 fixedly attached to the thread feeding unit board 10*a* fixed to the machine frame 2*d*, gripping discs 57 pivotally supported by the upstream gripping shaft 56, spring holders 58, and compression springs 59. Each set of the gripping disc 57, the spring holder 58, and the compression spring 59 is provided between the upstream gripper support plates 55.

The downstream grippers 12*a* to 12*d* are provided on the thread feeding unit board 10*b* which is fixed to the thread feeding unit board 10*a* fixed to the machine frame 2*d*, thread accumulation amount control element support shafts 19*a*, spacers 19*b*, thread accumulating element support shafts 19*c*, and spacers 19*d* being fixed to the thread feeding unit board 10*b* by coupling screws 69. The left needle thread downstream gripper 12*a*, the right needle thread downstream gripper 12*b*, the upper looper thread downstream gripper 12*c*, and the lower looper thread downstream gripper 12*d* have a downstream gripping shaft 72 pivotally attached to five downstream gripper support plates 43 fixedly attached to the thread feeding unit board 10*b*, gripping discs 44, spring holders 45, and compression springs 46, which are pivotally supported by the downstream gripping shaft 72. Each set of the gripping disc 44, the spring holder 45, and the compression spring 46 is provided between the downstream gripper support plates 43.

The upstream thread accumulating elements 13*a* to 13*d* and the downstream thread accumulating elements 14*a* to 14*d* are adapted to measure the thread accumulation amount of a predetermined length of each of the needle thread, the upper looper thread and the lower looper thread. The upstream thread accumulating elements 13*a* to 13*d* are integrally formed, and the downstream thread accumulating elements 14*a* to 14*d* are integrally formed. The upstream thread accumulating elements 13*a* to 13*d* and the downstream thread accumulating elements 14*a* to 14*d* have thread slots 3*e* to 13*h* and 14*e* to 14*h*, respectively, through which the sewing threads, namely, the left needle thread 9*a*, the right needle thread 9*b*, the upper looper thread 9*c* and the lower looper thread 9*d* pass, and which measure the thread accumulation amount of the thread accumulator 500.

The upstream thread accumulating elements 13*a* to 13*d* and the downstream thread accumulating elements 14*a* to 14*d* are connected by a screw 159 through the intermediary of a thread accumulating element coupling shaft 156 and a spacer 158. The upstream thread accumulating elements 13*a* to 13*d* and the downstream thread accumulating elements 14*a* to 14*d* are mounted so as to be guided by two thread accumulating element support shafts 19*c* fixedly attached to the thread feeding unit boards 10*a* and 10*b* and to slide within thread accumulating element slots 13*j*, 14*j*, 13*k* and 14*k*.

A thread accumulating element drive gear 150 fixed to the upper shaft 3*a* engages with an intermediate gear 152 fixed to a support shaft 151, and the intermediate gear 152 engages with a grooved cam gear 154 fixed to a grooved cam shaft 153. The ratio of number of teeth between the thread accumulating element drive gear 150 and the grooved cam gear 154 is 1 to 1, and the thread accumulating element drive gear 150 rotates in the same direction as that of the grooved cam gear 154 due to the interposition of the intermediate gear 152. A grooved cam 155 is fixedly attached to the grooved cam shaft 153, and a cam follower 157, which is a roller installed to the thread accumulating element coupling shaft 156, is fitted in the grooved cam 155. Thus, the upstream thread accumulating elements 13*a* to 13*d* and the downstream thread accumulating elements 14*a* to 14*d* reciprocate in synchronization with the rotation of the upper shaft 3*a* in the transverse direction.

The left needle thread accumulation amount control element 15 and the right needle thread accumulation amount control element 16, and the upper looper thread accumulation amount control element 17 and the lower looper thread accumulation amount control element 18 are supported, in a reciprocatably slidable manner, along upper guide slots 21*a*, 21*b*, 21*c* and 21*d* and lower guide slots 22*a* and 22*b* by the thread accumulation amount control element support shafts 19*a*, the spacers 19*b* and lower support shaft 20*a* and 20*b*.

The left needle thread accumulation amount control element 15, the right needle thread accumulation amount control element 16, the upper looper thread accumulation amount control element 17, and the lower looper thread accumulation amount control element 18 are adapted to adjust the sewing thread amounts of the needle threads, the upper looper thread, and the lower looper thread that are required for sewing one stitch in an increasable and decreasable manner within the range of the thread accumulation amount of a predetermined length when feeding the fabric f, and to release the sewing threads to the stitch forming device 100 when forming a stitch, and have slits 15*a*, 16*a*, 17*a* and 18*a*.

The left needle thread accumulation amount control element 15, the right needle thread accumulation amount control element 16, the upper looper thread accumulation amount control element 17, and the lower looper thread accumulation amount control element 18 are driven by the thread feed drive mechanism 600.

Thread Feed Drive Mechanism:

The thread feed dive mechanism 600 is adapted to drive the left needle thread accumulation amount control element 15, the right needle thread accumulation amount control element 16, the upper looper thread accumulation amount control element 17, and the lower looper thread accumulation amount control element 18 of the thread accumulator 500, as illustrated in FIG. 4 to FIG. 7, FIG. 13A and FIG. 13B. The thread feed drive mechanism 600 is composed of pulse motors M1, M2, M3 and M4 controlled by the thread feed control unit 700, which will be described later, and racks 15*g*, 16*g*, 17*g* and 18*g* and pinions Mg1, Mg2, Mg3 and Mg4, which convert the rotations of the pulse motors M1, M2, M3 and M4 to motions for moving the left needle thread accumulation amount control element 15, the right needle thread accumulation amount control element 16, the upper looper thread accumulation amount control element 17, and the lower looper thread accumulation amount control element 18 of the thread accumulator 500, and is adapted to feed the left needle thread 9*a*, the right needle thread 9*b*, the upper looper thread 9*c*, and the lower looper thread 9*d*.

The pulse motors M1, M2, M3 and M4 of the drive mechanism 600 are driven by a central processing unit CPU through pulse motor drive circuits 715,716,717 and 718.

The upper shaft 3*a* is provided with a thread accumulating element actuation detection device 23 (FIG. 2). In the thread accumulating element actuation detection device 23, a rotary plate segment 23*a* fixed to the upper shaft 3*a* sends ON/OFF signals for turning a light transmitter-receiver (photocoupler) 23*b* ON/OFF to the central processing unit CPU to determine the timings for driving the pulse motors M1, M2, M3 and M4.

The sewing motor M is driven through a sewing motor drive circuit 714.

The upper shaft 3*a* is provided with a sewing machine rotational speed detection device 22 (FIG. 2). In the sewing machine rotational speed detection device 22, a rotary plate segment 22*f* fixed to the upper shaft 3*a* sends ON/OFF signals for turning a light transmitter-receiver (photocoupler) 22*g* ON/OFF to the central processing unit CPU.

Thread Feed Control Unit:

As illustrated in FIG. 4 to FIG. 7 and FIG. 13A to FIG. 16, the thread feeding device 1 of the decorative stitch sewing machine 2 in accordance with the present invention is provided with the thread feed control unit 700. The thread feed control unit 700 has a program for driving the left needle thread accumulation amount control element 15, the right needle thread accumulation amount control element 16, the upper looper thread accumulation amount control element 17, and the lower looper thread accumulation amount control element 18 of the thread accumulator 500 through the intermediary of the thread feed drive mechanism 600 for each stitch to feed, in an increasable and decreasable manner the right needle thread 9*b*, the upper looper thread 9*c* and the lower looper thread 9*d* such that a thread feed expression given below is satisfied, increasing or decreasing the left needle thread 9*a*, the right needle thread 9*b*, the upper looper thread 9*c* and the lower looper thread 9*d* within the range of a total thread feeding amount that is set to be constant, including a fabric feeding amount, a fabric thickness and an overlocking width for each stitch so as to change the position of a stitch looping point ipn (n=1, 2, 3 . . . 21) of the left needle thread 9*a*, the right needle thread 9*b*, the upper looper thread 9*c* and the lower looper thread 9*d*, thereby controlling the decorative stitching according to a stitching decoration pattern (FIG. 17).

$$\begin{aligned} L &= L_N + L_U + L_D \\ &= [p + 2t + Ek_{PN}] + [2Ek_{PU} + t] + [2Ek_{PD} + t] \\ &= E(k_{PN} + 2k_{PU} + 2k_{PD}) + 4t + p \end{aligned}$$

(where L: total thread feeding amount; $L_N$: needle thread feeding amount; $L_U$: upper looper thread feeding amount; $L_D$: lower looper thread feeding amount; p: fabric feeding amount; t: fabric thickness; E: overlocking width; kw: needle thread coefficient related to fabric feeding amount; $k_{PU}$: upper looper thread coefficient related to fabric feed overlocking width amount; and $k_{PD}$: lower looper thread coefficient related to fabric feed overlocking width amount)

The needle thread coefficient $k_{PN}$, the upper looper thread coefficient $k_{PU}$, and the lower looper thread coefficient $k_{PD}$ denote the values for increasing or decreasing the thread amounts determined by experiments based on the thickness, the stiffness and the stretchability of threads, the stiffness and stretchability of fabric, and the like in order to create good texture or beauty of the sewn stitches of decorative stitching.

If the length in the sewing direction of one stitch decoration pattern is denoted by $P_L$, then the number of stitches n in the one decoration pattern will be $P_L$/p. The fabric feeding amount (pitch) p can be randomly determined within the range of 1 to 4 mm, and the length $P_L$ in the sewing direction of the one stitch decoration pattern can be randomly determined within the range of $P_L$>p, so that the number of stitches n in the one stitching decoration pattern can be also freely determined.

According to the thread feeding device 1 of the decorative stitch sewing machine 2, the program includes:

a thread accumulation step of accumulating the left needle thread 9*a*, the right needle thread 9*b*, the upper looper thread 9*c*, and the lower looper thread 9*d* by the thread accumulator 500 in the sewing thread amounts required for one stitch in a one stitch fabric feeding step immediately before one stitch forming step; and a thread release step of releasing the left needle thread 9*a*, the right needle thread 9*b*, the upper looper thread 9*c*, and the lower looper thread 9*d* to the left needle 5, the right needle 6, the upper looper 7, and the lower looper 8, respectively, of the stitch forming device stitch forming device 100 in the stitch forming step of one stitch immediately after the one stitch fabric feeding step.

According to the thread feeding device of a decorative stitch sewing machine, in the thread accumulation step, the total thread feeding amount L is increased or decreased according to the fabric feeding amount p per stitch, the fabric thickness t, the overlocking width E, and the shape of a stitching decoration pattern, and then a calculation result is allocated to each of the needle threads, the upper looper thread, and the lower looper thread.

According to the thread feeding device of a decorative stitch sewing machine, the program includes:

a step of determining the sewing thread amount of each of the left needle thread 9*a*, the right needle thread 9*b*, the upper looper thread 9*c* and the lower looper thread 9*d* according to the relative displacement positions of the upstream thread accumulating elements 13*a* to 13*d* and the downstream thread accumulating elements 14*a* to 14*d*, the left needle thread accumulation amount control element 15, the right needle thread accumulation amount control element 16, the upper looper thread accumulation amount control element 17, and the lower looper thread accumulation amount control element 18 in the thread accumulator 500.

The measurement of each of the sewing thread amounts will be described with reference to FIGS. 13A and 13B by taking the left needle thread 9*a* as an example.

Figure 13A:
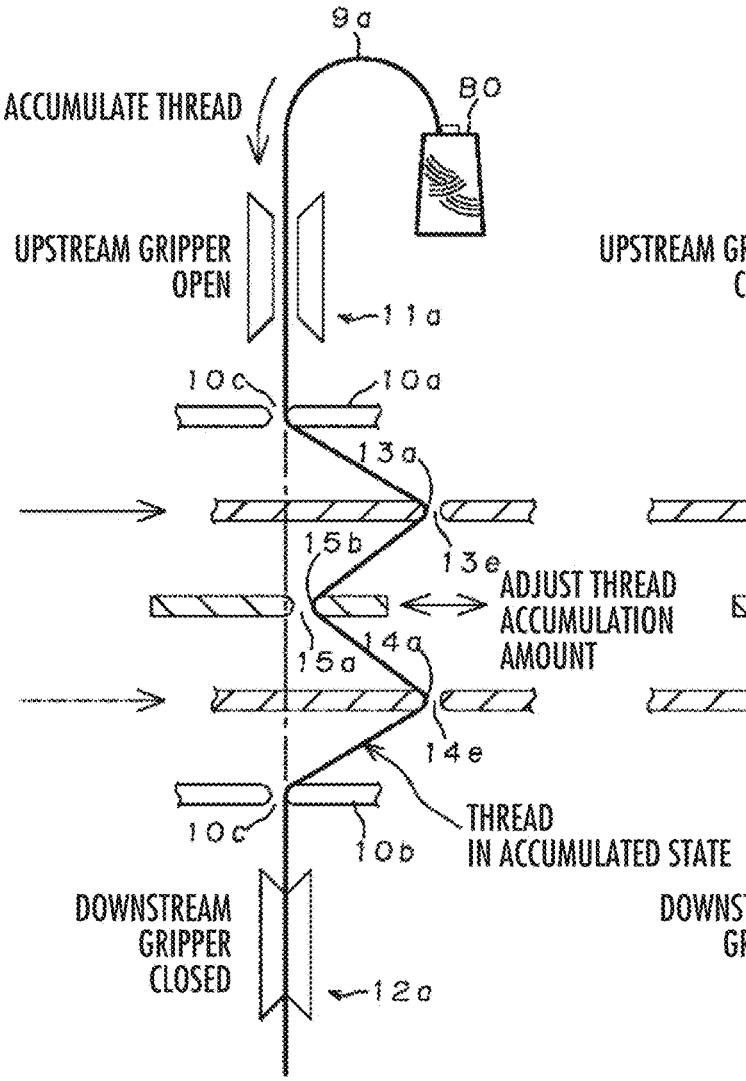
FIGS. 13A and 13 B present explanatory diagrams illustrating the thread accumulator applied to the thread feeding device in accordance with the present invention, FIG. 13A illustrating a thread in an accumulated state and FIG. 13B illustrating the thread in a released state.

Referring to FIG. 13A, in the state in which the left needle thread upstream gripper 11*a* of the thread accumulator 500 is opened when the fabric is fed by the fabric feeding device and the left needle downstream gripper 12*a* is closed, the left needle thread 9*a* from the spool Bo forms the M-shaped thread path due to the relative positional relationship among the both left needle thread slits 10*c* which provide the fixed reference points of the thread feeding unit boards 10*a* and 10*b*, the thread lots 13*e* and 4*e* positioned as the result of the displacement of the left needle thread upstream thread accumulating element 13*a* and the left needle thread downstream thread accumulating element 14*a*, and a slit 15*a* positioned as the result of the displacement of the left needle thread accumulation amount control element 15.

Figure 13B:
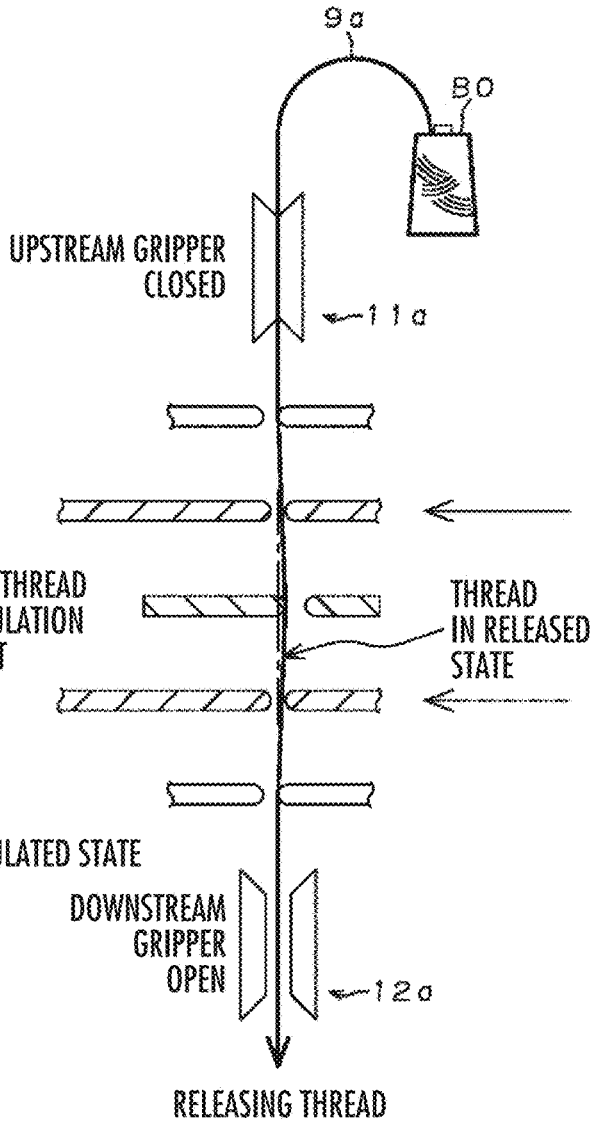

Referring to FIG. 13B, in the state in which the left needle thread upstream gripper 11*a* of the thread accumulator 500 is closed when a stich is formed by the stitch forming device and the left needle downstream gripper 12*a* is opened when the fabric is fed by the fabric feeding device, the left needle thread downstream gripper 12*a* releases the measured and accumulated thread in the sewing thread amount to the left needle 5 of the stitch forming device 100. The sewing thread amount comes from the difference between the linear thread path observed in the state in which the left needle thread upstream thread accumulating element 13*a*, the left needle thread downstream thread accumulating element 14*a*, and the left needle thread accumulation amount control element 15 have not been relatively moved, and the M-shaped thread path observed in the state in which the left needle thread upstream thread accumulating element 13*a*, the left needle thread downstream thread accumulating element 14*a*, and the left needle thread accumulation amount control element 15 have been relatively moved.

The same applies to the sewing thread amounts of other threads, namely, the right needle thread 9*b*, the upper looper thread 9*c*, the lower looper thread 9*d*.

The thread accumulation step includes:

a thread accumulation amount measurement step of moving the upstream thread accumulating elements 13*a* to 13*d* and the downstream thread accumulating elements 14*a* to 14*d* to measure the thread accumulation amount of a predetermined length of each of the left needle thread 9*a*, the right needle thread 9*b*, the upper looper thread 9*c* and the lower looper thread 9*d;* a thread accumulation amount calculation step of increasing or decreasing the total thread feeding amount of the left needle thread 9*a*, the right needle thread 9*b*, the upper looper thread 9*c* and the lower looper thread 9*d* according to the fabric feeding amount p for each stitch, the fabric thickness t of the fabric f, the overlocking width E and the shape of a stitching decoration pattern, and then allocating an obtained calculation result to the needle threads, the upper looper thread and the lower looper thread; and a thread accumulation amount adjustment step of relatively moving the left needle thread accumulation amount control element 15, the right needle thread accumulation amount control element 16, the upper looper thread accumulation amount control element 17, and the lower looper thread accumulation amount control element 18 with respect to the upstream thread accumulating element and the downstream thread accumulating element so as to adjust the sewing thread amounts of the left needle thread 9*a*, the right needle thread 9*b*, the upper looper thread 9*c* and the lower looper thread 9*d* required for one stitch in an increasable and decreasable manner.

According to the thread feeding device 1 of the decorative stitch sewing machine 2, the thread accumulation amount adjustment step is carried out before the thread accumulation amount measurement step for the next stitch is started after the completion of the thread release step.

As illustrated in FIG. 2, the thread feeding device 1 of the decorative stitch sewing machine 2 is provided with a thread accumulating element actuation detection device 23 (FIG. 2), which detects the moment when the downstream grippers 12*a* to 12*d* are closed, applies the data of the detection to the thread feed control unit 700, and carries out the thread accumulation amount adjustment step before the thread accumulation amount adjustment step for the next stitch is begun after the completion of the thread release step. The thread accumulating element actuation detection device 23 is composed of the rotary plate segment 23*a* fixed to the upper shaft 3*a* and the light transmitter-receiver (photocoupler) 23*b*, and the ON/OFF signals for turning a light transmitter-receiver (photocoupler) 23*b* ON/OFF by the rotary plate segment 23*a* are input to the central processing unit CPU, thereby carrying out the thread accumulation amount adjustment step before the thread accumulation amount measurement step for the next stitch is begun after the completion of the thread release step.

As illustrated in FIG. 9, the thread feeding device 1 of the decorative stitch sewing machine 2 is provided with the feeding amount detection device 702 (FIG. 9), which detects the fabric feeding amount set by the fabric feeding device 200 that adjusts the feeding amount of the fabric f, and which applies the data of the detection to the thread feed control unit 700. The rotation of the stitch length adjustment dial 130 is adjusted by rotating the feeding amount detection device 702, which is a potentiometer provided on the substrate 202 through the intermediary of the feeding amount detection device arm 134*a*. Thus, the fabric feeding amount is detected on the basis of the rotation of the stitch length adjustment dial 130 and input to the central processing unit CPU of the thread feed control unit 700.

As illustrated in FIG. 9 and FIG. 10, the thread feeding device of the decorative stitch sewing machine is provided with the overlocking width detection device 704, which detects the overlocking width set by the overlocking width adjustment unit 320 that adjusts an overlocking width, and which applies the data of the detection to the thread feed control unit 700. The rotation of the overlocking width adjustment dial 321 is adjusted by rectilinearly moving the overlocking width detection device 704, which is a potentiometer installed to the lower end of the overlocking width adjustment base 322.

As illustrated in FIG. 11, the thread feeding device of the decorative stitch sewing machine is provided with the fabric thickness detection device 705, which detects the thickness of a fabric and applies the data of the detection to the central processing unit CPU of the thread feed control unit 700. The fabric pressing device 400 has a fabric thickness detection pin 402 implanted in the pressing bar 451, the fabric thickness detection cam 403 which is rotationally moved by the fabric thickness detection pin 402, and the fabric thickness detection device gear 406 rotated through the intermediary of the gear 405 engaging with the fabric thickness detection cam gear 404 of the fabric thickness detection cam 403. A fabric thickness detection device shaft 407 fixed to the fabric thickness detection device gear 406 rotates the fabric thickness detection device 705, which is a potentiometer, to make adjustment.

Figure 14:
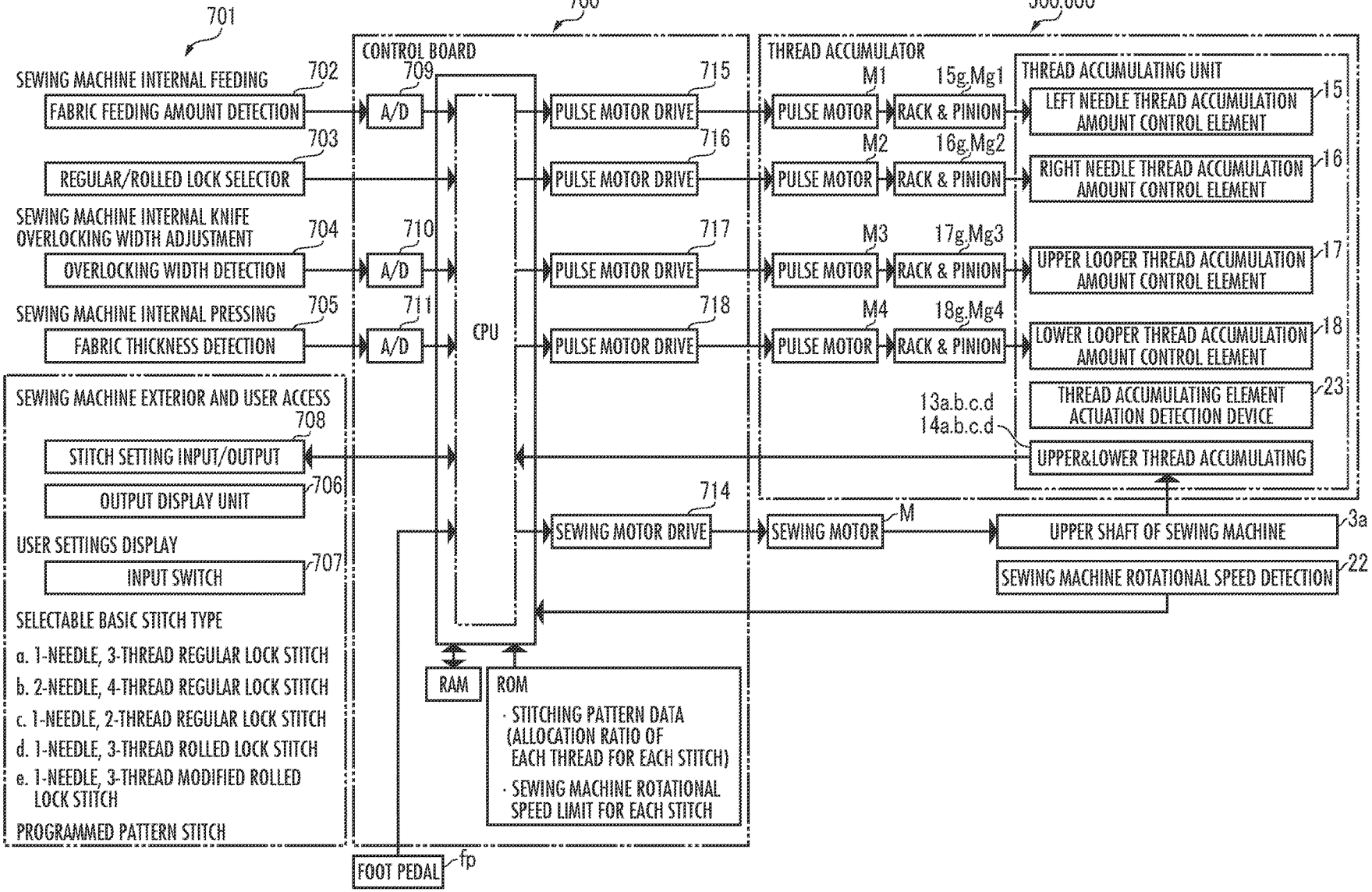
FIG. 14 is a block diagram of a thread feed drive mechanism and a thread feed control unit applied to the thread feeding device in accordance with the present invention.

As illustrated in FIG. 14, in the thread feeding device 1 of the decorative stitch sewing machine 2, connected to the central processing unit CPU are a random access memory RAM that executes a decorative stitching operation according to a stitching decoration pattern in the thread feeding device of the decorative stitch sewing machine, and a read-only memory ROM which stores stitching pattern data based on the allocation percentage of each thread for each stitch and a sewing machine rotational speed limit for each stitch in a program for controlling decorative stitching based on a stitching decoration pattern.

Further, the thread feeding device 1 of the decorative stitch sewing machine 2 has a console 701, which is connected to the central processing unit CPU and which is placed at the leg 2*b* of the decorative stitch sewing machine 2. In the console 701, the feeding amount detection device 702 serving as a sewing machine internal feeding mechanism, the overlocking width detection device 704 serving as a sewing machine internal knife overlocking width adjustment mechanism, and the fabric thickness detection device 705 serving as a sewing machine internal pressing mechanism are connected to the central processing unit CPU through the intermediary of A/D converter circuits 709,710 and 711, and a regular/rolled lock selector switch 703 is directly connected to the central processing unit CPU.

A stitch setting input/output console 708, which serves as a sewing machine exterior and user access unit and which has an output display unit 706 that displays user settings and an input switch 707 for selecting from among the basic stitching types shown below, is connected to the central processing unit CPU such that interactive input/output is performed.

Selecting basic stitch mode through the stitch setting input/output console 708 a. 1-needle, 3-thread regular lock stitch
b. 2-needle, 4-thread regular lock stitch
c. 1-needle, 2-thread regular lock stitch
d. 1-needle, 3-thread rolled lock stitch
e. 1-needle, 3-thread modified rolled lock stitch Any program patterns can be selected.

The regular lock stitch above refers to hem overlocking performed by a conventional overlock sewing machine, and the rolled lock stitch and the modified rolled lock stitch refer to conventionally known hem overlocking.

The sewing threads, namely, the left needle thread 9*a*, the right needle thread 9*b*, the upper looper thread 9*c*, and the lower looper thread 9*d* are passed, from the individual spools Bo thereof, through the upstream grippers 11*a*, 11*b*, 11*c* and 11*d*, the slits 10*c*, 10*d*, 10*e* and 10*f* of the thread feeding unit board 10*a*, the upstream thread accumulating elements 13*a*, 13*b*, 13*c* and 13*d*, the thread accumulation amount control elements 15*a*, 16*a*, 17*a* and 18*a*, the downstream thread accumulating elements 14*a*, 14*b*, 14*c* and 14*d*, the slits 10*c*, 10*d*, 10*e* and 10*f* of the thread feeding unit board 10*b*, and the downstream grippers 12*a*, 12*b*, 12*c* and 12*d*. The left and right needle threads are fed to the thread holes of the left needle 5 and the right needle 6 of the stitch forming device 100 along the thread path extending from a balance thread guide Tt to a needle thread balance Tg. The upper and lower looper threads are fed to the looper thread holes of the upper looper 7 and the lower looper 8 of the stitch forming device 100 along the thread path routed via a looper thread introduction mechanism 91.

The thread feeding device of a decorative stitch sewing machine in accordance with the present invention described above feeds a fabric by the fabric feeding device for each stitch, feeds a plurality of sewing threads, including the needle thread, the upper looper thread and the lower looper thread, to the stitch forming device, which forms stitches and which includes at least one needle, the upper looper and the lower looper, overlocks an edge of a fabric by interloop-locking the upper looper thread and the lower looper thread that are interloop-locked to the needle thread, and performs decorative stitching according to one stitching decoration pattern by changing the position of the stitch looping point of the needle thread, the upper looper thread and the lower looper thread for each stitch.

Figure 15:
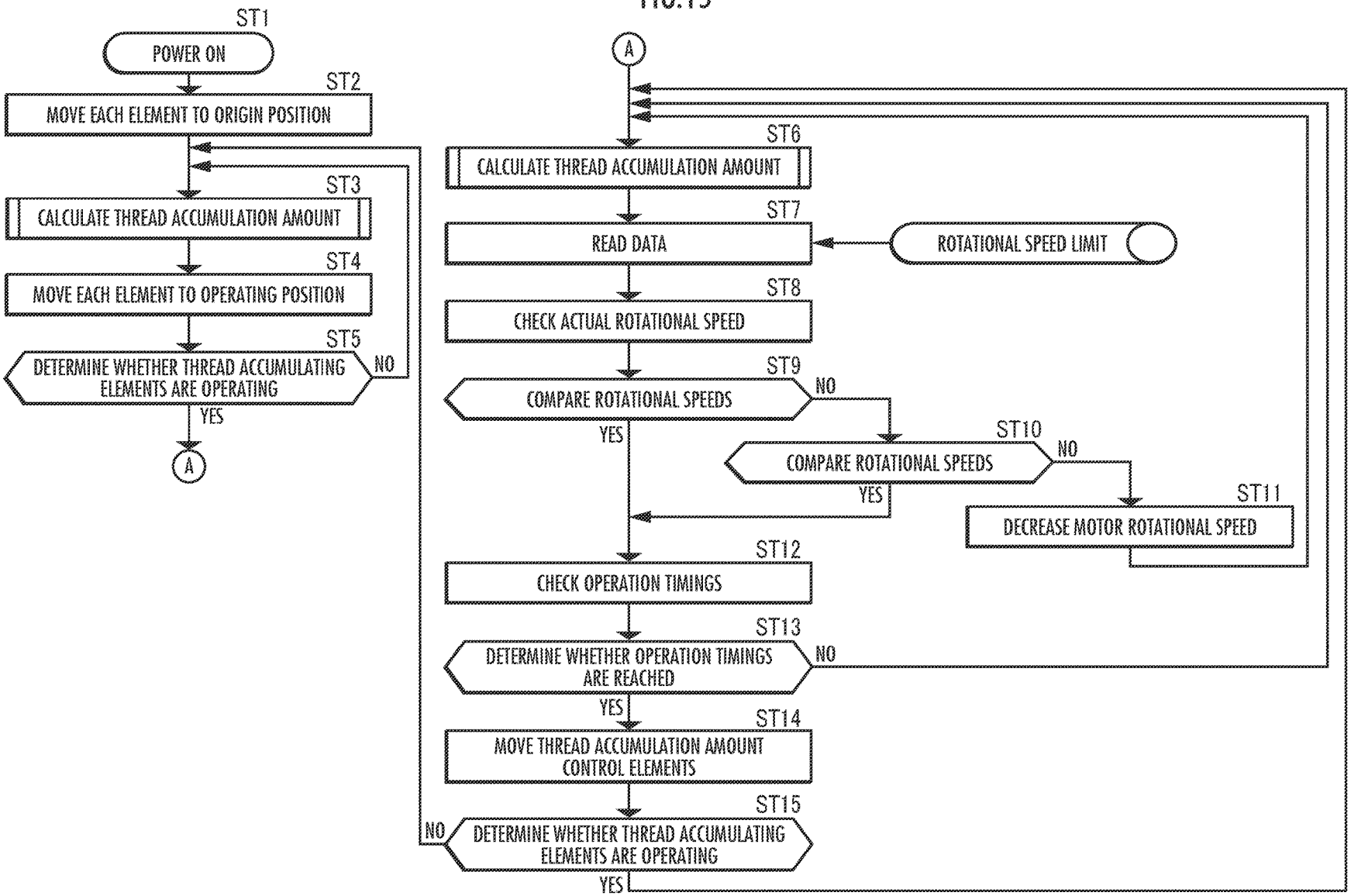
FIG. 15 is a flowchart of a thread feeding operation program for controlling decorative stitching by the thread feeding device of a decorative stitch sewing machine in accordance with the present invention.
Figure 16:
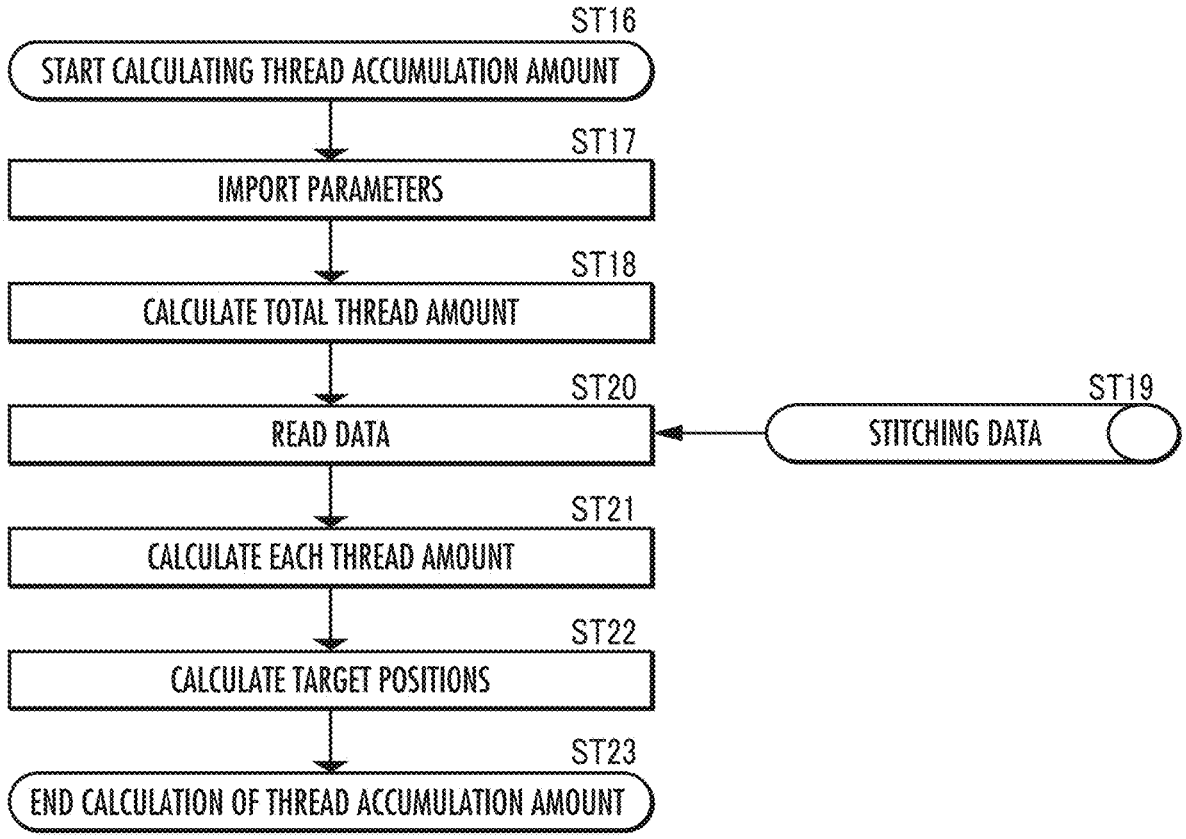
FIG. 16 is a flowchart of a thread feed calculation program for controlling the decorative stitching by the thread feeding device of a decorative stitch sewing machine in accordance with the present invention.
Figure 17:
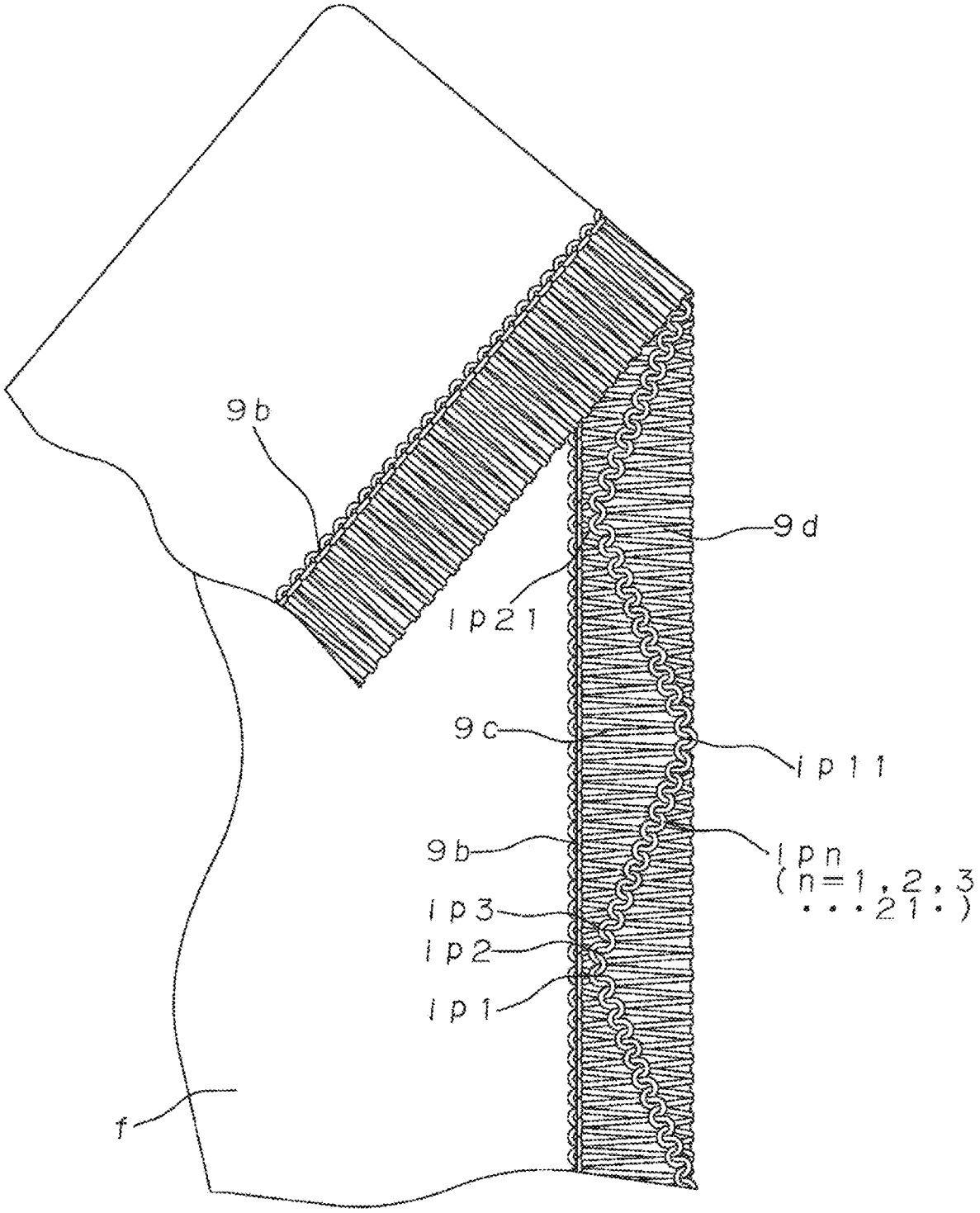
FIG. 17 is an explanatory diagram illustrating sewn upper and lower looper thread undulating stitches of 1-needle, 3-thread overlock stitching by the thread feeding device of a decorative stitch sewing machine in accordance with the present invention.

Referring now to FIG. 15 and FIG. 16, a description will be given of the operation steps for the 1-needle, 3-thread overlock stitch by the thread feeding device of the decorative sewing machine in accordance with the present invention configured as described above.

In this case, the 1-needle, 3-thread regular lock stitch is selected using the input switch 707 of the console 701, and the undulating shape stitching pattern is selected through the stitch setting input/output console 708. The right needle 6, the upper looper 7 and the lower looper 8 are individually threaded.

Step ST1: Turn power ON.

Step ST2: Move each of the right needle thread accumulation amount control element 16, the upper looper thread accumulation amount control element 17, and the lower looper thread accumulation amount control element 18 to origin positions.

Step ST3: Thread accumulation amount calculation processing

The thread accumulation amount calculation processing is carried out in the process of step ST16 to step ST23. (FIG. 16)

Step ST4: Operation instructions are issued to the pulse motors M2, M3 and M4 to move the right needle thread accumulation amount control element 16, the upper looper thread accumulation amount control element 17, and the lower looper thread accumulation amount control element 18 to operating positions.

Step ST5: Determine whether the thread accumulating elements 13 and 14 are operating.

Step ST6: Thread accumulation amount calculation processing

The thread accumulation amount calculation processing in step ST6 is carried out in the process of step ST16 to step ST23.

Step ST7: Read the sewing machine rotational speed limit for each stitching pattern stored in advance.

Step ST8: Check the actual sewing machine rotational speed by the sewing machine rotational speed detection device 22.

Step ST9: Determine whether the sewing machine rotational speed limit >the actual sewing machine rotational speed.

Step ST10: If the determination result in step ST9 is "NO," then determine whether the sewing machine rotational speed limit=the actual sewing machine rotational speed. If the determination result in step ST10 is "YES," then the program proceeds to step ST12.

Step ST11: If the determination result in step ST10 is "NO," then an instruction for decreasing the motor rotational speed of the sewing motor M is issued to the sewing motor drive circuit 714, and the program returns to step ST6.

Step ST12: Check the thread accumulating element actuation detection device 23 for the operation timings of the right needle thread accumulation amount control element 15, the upper looper thread accumulation amount control element 16, and the lower looper thread accumulation amount control element 18.

Step ST13: Determine whether the operation timings of the right needle thread accumulation amount control element 16, the upper looper thread accumulation amount control element 17, and the lower looper thread accumulation amount control element 18 are reached. If the determination result is "NO," then the program returns to step ST6.

After the thread release step is completed by ST10 and ST13, the thread accumulation amount adjustment step is carried out before the thread accumulation amount measurement step for the next stitch is started.

Step ST14: If the determination result in step ST13 is "YES," then an operation instruction is issued to each of the pulse motor drive circuits 716, 717 and 718 so as to move the right needle thread accumulation amount control element 16, the upper looper thread accumulation amount control element 17, and the lower looper thread accumulation amount control element 18 to the target positions of the thread accumulation amount control elements (specifically, the positions at which the required length of each of the right needle thread, the upper looper thread and the lower looper thread can be accumulated).

Step ST15: Determine whether the thread accumulating elements 13 and 14 are operating. If the determination result is "NO," then the program returns to step ST3, or if "YES," then the program returns to step ST6.

Step ST16: Start the thread accumulation amount calculation processing.

Step ST17: Import the fabric thickness t of the fabric f, the overlocking width B, and the fabric feeding amount p for each stitch.

Step ST18: Calculate the total thread feeding amount L used for one stitch on the basis of the fabric thickness t of the fabric f, the overlocking width B, and the fabric feeding amount p for each stitch.

Step ST19: Check stitching pattern data.

Step S120: Read the data for one stitch of a stitching pattern selected by a user.

Step ST21: Calculate the thread amount to be allocated to each of the right needle thread 9*b*, the upper looper thread 9*c* and the lower looper thread 9*d* on the basis of the stitching data selected by the user and the total thread feeding amount L of the threads used for one stitch and which is.

Step ST22: Calculate the target positions of the right needle thread accumulation amount control element 16, the upper looper thread accumulation amount control element 17, and the lower looper thread accumulation amount control element 18 on the basis of the thread amount allocated to each of the right needle thread 9*b*, the upper looper thread 9*c* and the lower looper thread 9*d*.

Step ST23: End of the thread accumulation amount calculation processing

According to the thread feeding device decorative stitch sewing machine in accordance with the present invention performing the 1-needle, 3-thread overlock, in the case where, for example, an undulating shape stitching pattern is selected, the sewn undulating stitches are as illustrated in FIG. 17. Referring to FIG. 17, if one pattern includes 21 stitches, then on both sides of the upper and lower looper thread looping points ipn (n=1, 2, 3 . . . ), the thread lengths of the upper looper thread 9*c* and the lower looper thread 9*d* gradually increase or decrease for each stitch from the upper and lower thread looping point ip2 to ip11, whereas the thread lengths of the lower looper thread 9*d* and the upper looper thread 9*c* gradually increase or decrease from the upper and lower thread looping point ip12 to ip21, thus forming the undulating stitches by the upper and lower looper thread looping points ipn (n=1, 2, 3 . . . ) to sew the undulating shape pattern.

Figure 18:
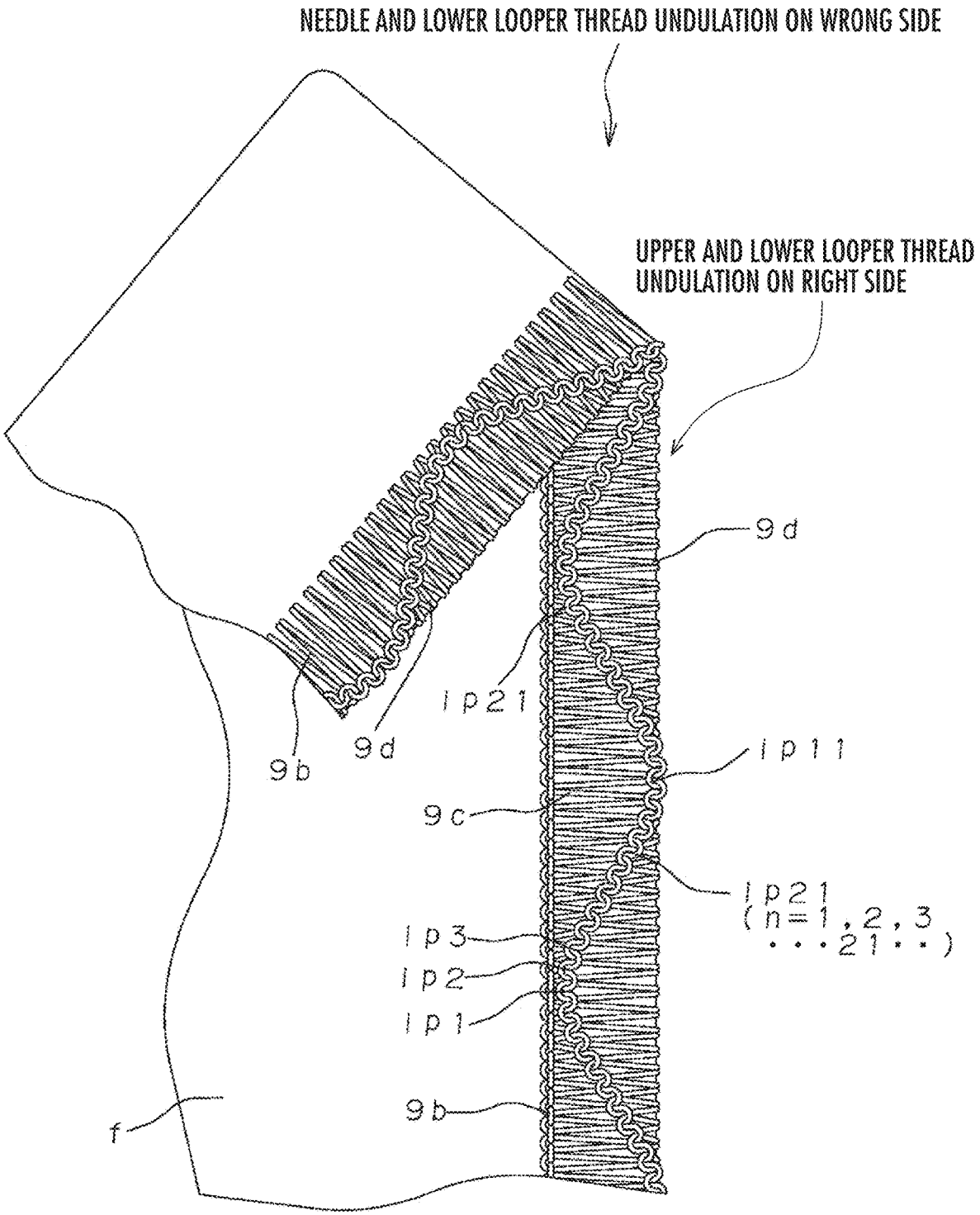
FIG. 18 is an explanatory diagram illustrating sewn needle thread undulating stitches of 1-needle, 3-thread overlock stitching by the thread feeding device of a decorative stitch sewing machine in accordance with the present invention.

Further, referring to FIG. 18, in addition to the looping points of the upper and lower looper threads, the looping points of the needle thread and the lower looper thread are also gradually increased or decreased to form the undulating stitches, thus sewing the undulating shape pattern.

In the foregoing embodiment, the description has been given of the case where the undulating shape is selected as the stitching pattern. Alternatively, however, any stitching pattern, such as a triangular pattern, a trapezoidal pattern, or an elliptical pattern, can be selected and sewn.

Further, in the foregoing embodiment, the description has been given of the 1-needle, 3-thread overlock stitch performed by the decorative stitch sewing machine in accordance with the present invention. However, the present invention can be applied also to a decorative stitch sewing machine performing 2-needle, 4-thread overlock.

In this case, the thread feed control unit 700 has a program for, driving the left needle thread accumulation amount control element 15, the right needle thread accumulation amount control element 16, the upper looper thread accumulation amount control element 17, and the lower looper thread accumulation amount control element 18 of the thread accumulator 500 through the intermediary of the thread feed drive mechanism 600 for each stitch so as to feed, in an increasable and decreasable manner, the left needle thread 9*a*, the right needle thread 9*b*, the upper looper thread 9*c* and the lower looper thread 9*d* such that a thread feed expression given below is satisfied; and increasing or decreasing the left needle thread 9*a*, the right needle thread 9*b*, the upper looper thread 9*c* and the lower looper thread 9*d* within the range of a total thread feeding amount, which is set to be constant, including a fabric feeding amount, a fabric thickness and an overlocking width for each stitch thereby to change the position of the stitch looping point ipn (n=1, 2, 3 . . . 21) of the left needle thread 9*a*, the right needle thread 9*b*, the upper looper thread 9*c* and the lower looper thread 9*d*, thus controlling the decorative stitching according to a stitching decoration pattern (FIG. 17).

$$L = L_{N1} + L_{N2} + L_U + L_D$$
$$= [p + 2t + Fk_{PN}] + [p + 2t] + [2(F + E)k_{PU} + t] + [2(F + E)k_{PD} + t)$$
$$= Fk_{PN} + 2(F + E)(k_{PU} + k_{PD}) + 6t + 2p$$

(where $L_{N1}$: left needle thread feeding amount; $L_{N2}$: right needle thread feeding amount; and F: distance between left and right needles)

The difference from the decorative stitch sewing machine performing the 1-needle, 3-thread overlock is the addition of the stitch width F.

If the length in the sewing direction of the one stitch decoration pattern is denoted by $P_L$, then the number of stitches n in the one stitch decoration pattern will be $n=P_L/p$. However, the fabric feeding amount (pitch) p can be randomly determined within the range of 1 to 4 mm, and the length $P_L$ in the sewing direction of the one stitch decoration pattern can be randomly determined within the range of $P_L>p$, so that the number of stitches n in the one stitch decoration pattern can be also freely determined.

Figure 19:
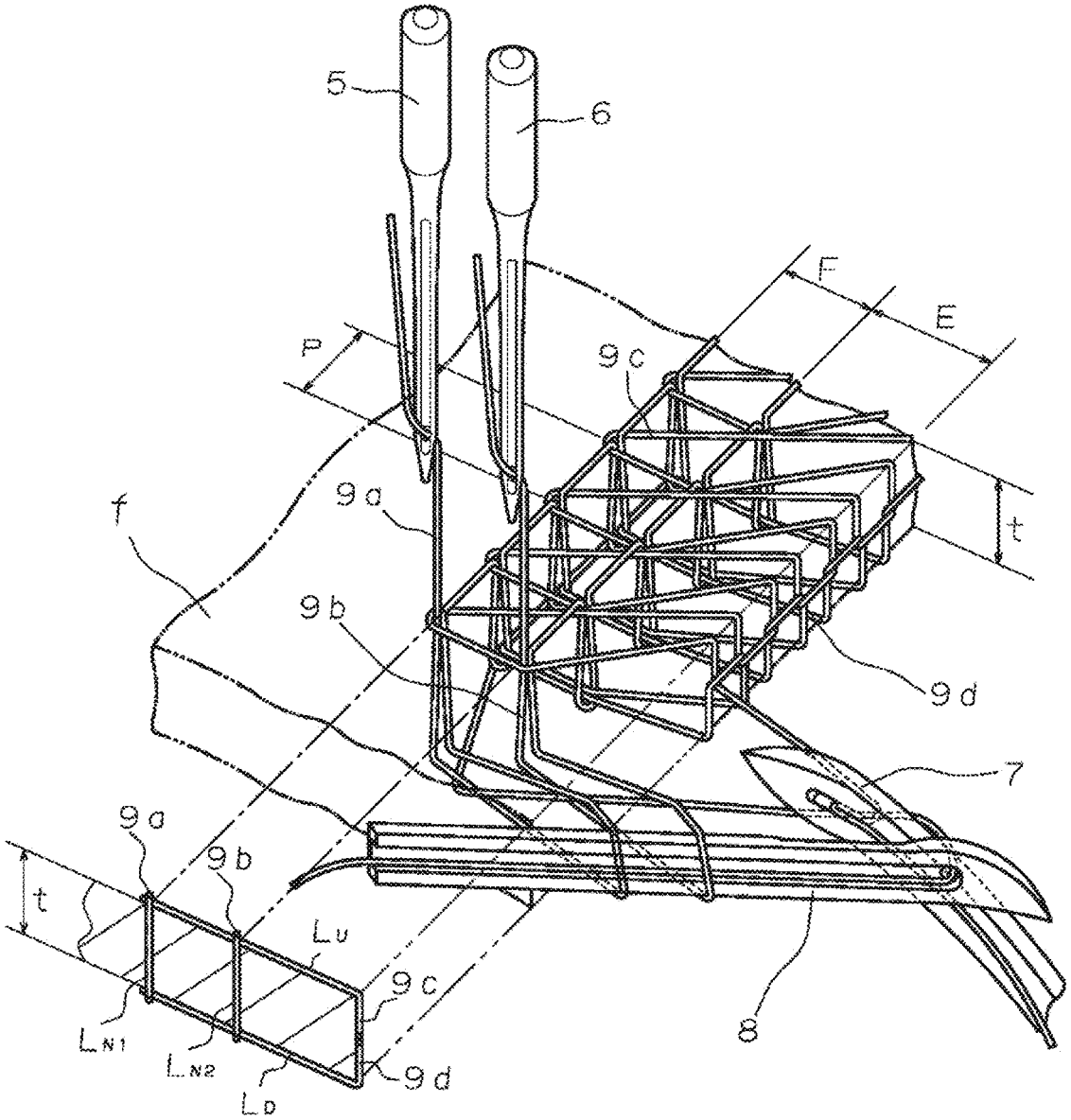
FIG. 19 is an explanatory diagram illustrating stitches of 2-needle, 4-thread overlock stitching by the thread feeding device of a decorative stitch sewing machine in accordance with the present invention.
Figure 20:
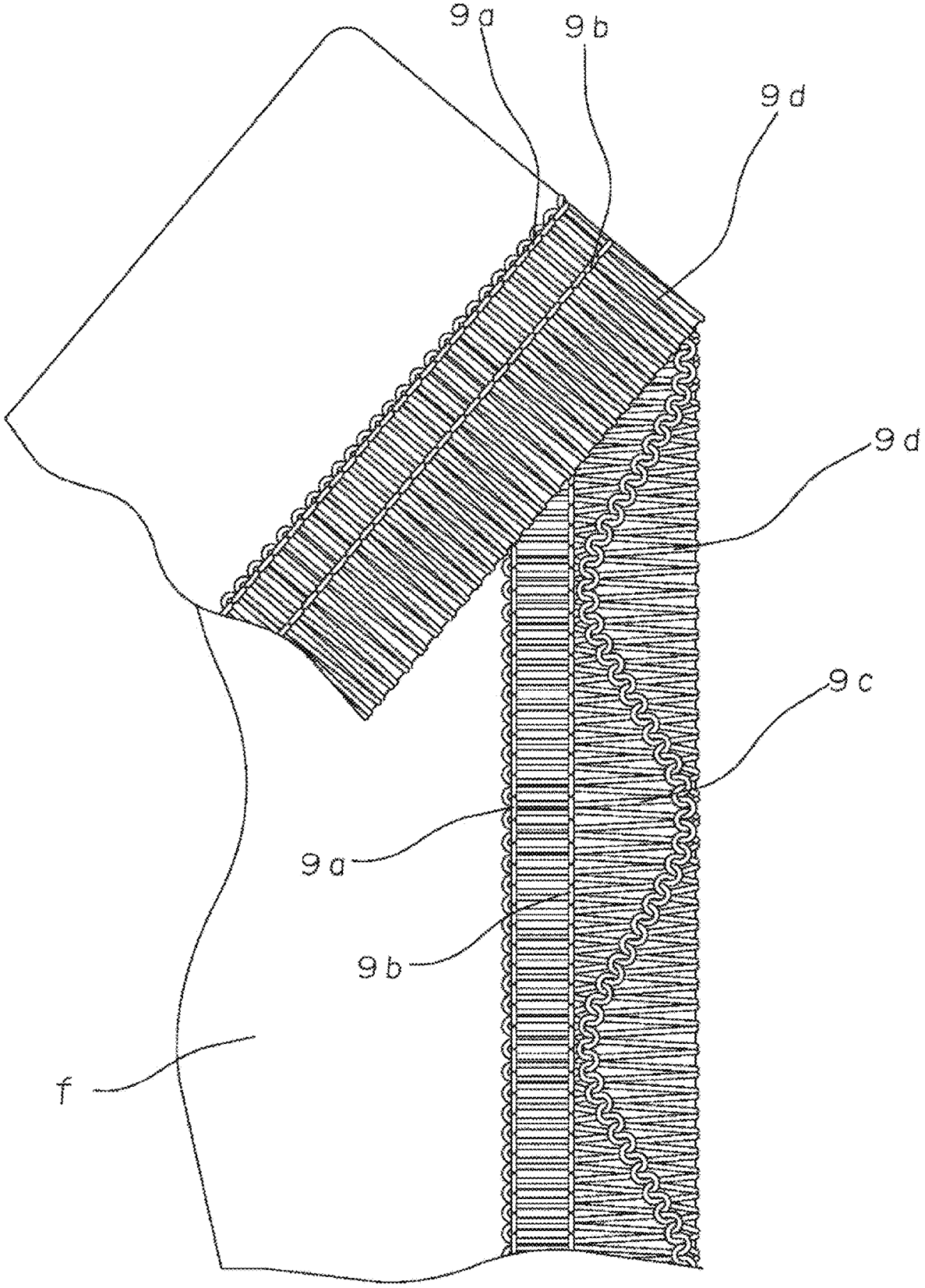
FIG. 20 is an explanatory diagram illustrating sewn undulating stitches of 2-needle, 4-thread overlock stitching by the thread feeding device of a decorative stitch sewing machine in accordance with the present invention.

According to the thread feeding device of decorative stitch sewing machine performing the 2-needle, 4-thread overlock, if an undulating shape stitching pattern is selected, then the sewn undulating stitches will be as illustrated in FIG. 19 and FIG. 20.

DESCRIPTION OF REFERENCE NUMERALS

1 . . . thread feeding device
2 . . . decorative stitch sewing machine
2*a* . . . bed
2*b* . . . leg
2*c* . . . arm
2*d* . . . machine frame
3*a* . . . upper shaft
3*b* . . . lower shaft
5 . . . left needle
6 . . . right needle
7 . . . upper looper
8 . . . lower looper
9*a* . . . left needle thread
9*b* . . . right needle thread
9*c* . . . upper looper thread
9*d* . . . lower looper thread
W . . . flywheel
M . . . sewing motor
M1 . . . pulse motor
M2 . . . pulse motor
M3 . . . pulse motor
M4 . . . pulse motor
500 . . . thread accumulator
10*a* . . . thread feeding unit board
10*b* . . . thread feeding unit board
10*c* . . . left needle thread slit
10*d* . . . right needle thread slit
10*e* . . . upper looper thread slit
10*f* . . . lower looper thread slit
11*a* . . . left needle thread upstream gripper
1*lb* . . . right needle thread upstream gripper
11*c* . . . upper looper thread upstream gripper
11*d* . . . lower looper thread upstream gripper
12*a* . . . left needle thread downstream gripper
12*b* . . . right needle thread downstream gripper
12*c* . . . upper looper thread downstream gripper
12*d* . . . lower looper thread downstream gripper
13 . . . upstream thread accumulating element
13*a* . . . left needle thread upstream thread accumulating element
13*b* . . . right needle thread upstream thread accumulating element
13*c* . . . upper looper thread upstream thread accumulating element
13*e* to 13*h* . . . tread slot
13*d* . . . lower looper thread upstream thread accumulating element
14 . . . downstream thread accumulating element
14*a* . . . left needle thread downstream thread accumulating element
14*b* . . . right needle thread downstream thread accumulating element
14*c* . . . upper looper thread downstream thread accumulating element
14*d* . . . lower looper thread downstream thread accumulating element
14*e* to 14*h* . . . thread slot
15 . . . left needle thread accumulation amount control element
15*a* . . . slit
15*g*, 16*g*, 17*g*, 18*g* . . . rack
Mg1, Mg2, Mg3, Mg4 . . . pinion
16 . . . right needle thread accumulation amount control element
16*a* . . . slit
17 . . . upper looper thread accumulation amount control element
17*a* . . . slit
18 . . . lower looper thread accumulation amount control element
18*a* . . . slit
19*a* . . . thread accumulation amount control element support shaft
19*b* . . . spacer
19*c* . . . thread accumulating element support shaft
19*d* . . . spacer
22 . . . sewing machine rotational speed detection device
22*f* . . . rotary plate segment
22*g* . . . light transmitter-receiver (photocoupler)
23 . . . thread accumulating element actuation detection device
23*a* . . . rotary plate segment
23*b* . . . light transmitter-receiver (photocoupler)
30 . . . needle drive mechanism
43 . . . five downstream gripper support plates
45 . . . spring holder
46 . . . compression spring
55 . . . five upstream gripper support plates
56 . . . upstream gripping shaft
57 . . . gripping disc
58 . . . spring holder
59 . . . compression spring
69 . . . coupling screw
70 . . . looper drive mechanism
72 . . . downstream gripping shaft
91 . . . looper thread introduction mechanism
100 . . . stitch forming device
200 . . . fabric feeding device
130 . . . stitch length adjustment dial
134 . . . adjustment arm
137 . . . needle plate
150 . . . thread accumulating element drive gear

151 . . . support shaft
152 . . . intermediate gear
153 . . . grooved cam shaft
154 . . . grooved cam gear
155 . . . grooved cam
156 . . . thread accumulating element coupling shaft
157 . . . cam follower
158 . . . spacer
159 . . . screw
202 . . . substrate
300 . . . fabric cutting device
307 . . . fixed knife
308 . . . movable knife
320 . . . overlocking width adjustment unit
321 . . . overlocking width adjustment dial
322 . . . overlocking width adjustment base
323 . . . actuation arm
400 . . . fabric pressing device
402 . . . fabric thickness detection pin
403 . . . fabric thickness detection cam
404 . . . gear
405 . . . gear
406 . . . gear
407 . . . fabric thickness detection device shaft
450 . . . fabric presser
451 . . . pressing bar
452 . . . pressing bar holder
453 . . . bearing
454 . . . spring
500 . . . thread accumulator
600 . . . thread feed drive mechanism
700 . . . thread feed control unit
701 . . . console
702 . . . feeding amount detection device
703 . . . regular/rolled lock selector switch
704 . . . overlocking width detection device
705 . . . fabric thickness detection device
706 . . . output display unit
707 . . . input switch
708 . . . stitch setting input/output console
709, 710, 711 . . . A/D converter circuit
714 . . . motor drive circuit
715 . . . pulse motor drive circuit
716 . . . pulse motor drive circuit
717 . . . pulse motor drive circuit
718 . . . pulse motor drive circuit
CPU . . . central processing unit
Bo . . . spool
f . . . . Fabric
fp . . . foot pedal
p . . . fabric feeding amount
t . . . fabric thickness t of fabric f
E . . . overlocking width
F . . . needle interval

The invention claimed is:

1. A thread feeding device of a decorative stitch sewing machine configured to feed a fabric by a fabric feeding device for each stitch and to supply a plurality of sewing threads, including a needle thread, an upper looper thread, and a lower looper thread to a stitch forming device which includes at least one needle, an upper looper, and a lower looper that form a stitch on the fabric so as to interloop the upper looper thread and the lower looper thread, which are looped to the needle thread thereby to form hemstitches on a hem of the fabric, and configured to perform decorative stitching according to a stitching decoration pattern by changing a position of a stitch looping point of the needle thread, the upper looper thread and the lower looper thread, the thread feeding device comprising:

(a) an upstream gripper, which grips a sewing thread in a thread path of the sewing thread fed from a bobbin, which is closed at the time of forming a stitch by the stitch forming device, and which is opened at a time of feeding the fabric by the fabric feeding device, and a downstream gripper, which grips the sewing thread introduced from the upstream gripper, which is opened to draw out the sewing thread by the stitch forming device at the time of forming a stitch, and which is closed at the time of feeding the fabric; (b) an upstream thread accumulating element and a downstream thread accumulating element, which extend between the upstream gripper and the downstream gripper and which measure a thread accumulation amount of a predetermined length of each of the needle thread, the upper looper thread and the lower looper thread; and (c) a thread accumulator which has a needle thread accumulation amount control element, an upper looper thread accumulation amount control element, and a lower looper thread accumulation amount control element, each of which extends between the upstream thread accumulating element and the downstream thread accumulating element, and adjusts in an increasable and decreasable manner the sewing thread amount of each of the needle thread, the upper looper thread and the lower looper thread required for sewing one stitch within the range of the thread accumulation amount of the predetermined length at the time of feeding the fabric, and which releases the threads to the stitch forming device at the time of forming a stitch, the thread accumulator being driven in synchronization with the fabric feeding device and the stitch forming device;

a thread feed drive mechanism which drives each of the needle thread accumulation amount control element, the upper looper thread accumulation amount control element, and the lower looper thread accumulation amount control element of the thread accumulator; and a thread feed control unit having a program which drives the needle thread accumulation amount control element, the upper looper thread accumulation amount control element, and the lower looper thread accumulation amount control element of the thread accumulator through an intermediary of the thread feed drive mechanism for each stitch to feed each of the needle thread, the upper looper thread and the lower looper thread in an increasable and decreasable manner such that a thread feed expression is satisfied, and which increases or decreases the needle thread, the upper looper thread and the lower looper thread within a range of a total thread feeding amount that is maintained constant, including a fabric feeding amount, a fabric thickness and an overlocking width, so as to change the position of the stitch looping point of the needle thread, the upper looper thread and the lower looper thread thereby to control decorative stitching according to the stitching decoration pattern, wherein the thread feed expression is given by:

$$L = L_N + L_U + L_D$$
$$= [p + 2t + Ek_{PN}] + [2Ek_{PU} + t] + [2Ek_{PD} + t]$$
$$= E(k_{PN} + 2k_{PU} + 2k_{PD}) + 4t + p$$

where L: total thread feeding amount; $L_N$: needle thread feeding amount; $L_u$: upper looper thread feeding amount; $L_D$: lower looper thread feeding amount; p: fabric feeding amount; t: fabric thickness; E: overlocking width; $k_{PN}$: needle thread coefficient related to fabric feeding amount; $k_{PU}$: upper looper thread coefficient related to fabric feed amount; and $k_{PD}$: lower looper thread coefficient related to fabric feed amount.

2. The thread feeding device of a decorative stitch sewing machine according to claim 1, wherein the program includes:

a thread accumulation step of accumulating, by the thread accumulator, each of the needle thread, the upper looper thread, and the lower looper thread in a sewing thread amount required for sewing one stitch in a fabric feeding step of one stitch immediately before a stitch forming step of one stitch; and a thread release step of releasing the needle thread, the upper looper thread, and the lower looper thread to the needle, the upper looper, and the lower looper, respectively, of the stitch forming device in the stitch forming step of one stitch immediately after the fabric feeding step for the one stitch.

3. The thread feeding device of a decorative stitch sewing machine according to claim 2, wherein the total thread feeding amount is increased or decreased according to the fabric feeding amount, the fabric thickness, the overlocking width, and a shape of the decoration stitching pattern and then allocated to each of the needle thread, the upper looper thread, and the lower looper thread in the thread accumulation step.

4. The thread feeding device of a decorative stitch sewing machine according to claim 2, wherein the program includes:

a step of determining the sewing thread amount of each of the needle thread, the upper looper thread, and the lower looper thread according to relative displacement positions of the upstream thread accumulating element and the downstream thread accumulating element in relation to, the needle thread accumulation amount control element, the upper looper thread accumulation amount control element, and the lower looper thread accumulation amount control element in the thread accumulator.

5. The thread feeding device of a decorative stitch sewing machine according to claim 4, wherein the thread accumulation amount adjustment step is carried out before the thread accumulation amount measurement step for the next one stitch is started, after the completion of the thread release step.

6. The thread feeding device of a decorative stitch sewing machine according to claim 2, wherein the thread accumulation step of accumulating, by the thread accumulator, each of the needle thread, the upper looper thread, and the lower looper thread in the sewing thread amount required for sewing one stitch in the fabric feeding step of one stitch immediately before a stitch forming step of one stitch includes:

a thread accumulation amount measurement step of moving the upstream thread accumulating element and the downstream thread accumulating element to measure the thread accumulation amount of the predetermined length of each of the needle thread, the upper looper thread, and the lower looper thread;

a thread accumulation amount calculation step of increasing or decreasing the total thread feeding amount of the needle thread, the upper looper thread, and the lower looper thread according to the fabric feeding amount, the fabric thickness, the overlocking width, and the shape of the stitching decoration pattern, and then allocating a calculation result to each of the needle thread, the upper looper thread, and the lower looper thread; and a thread accumulation amount adjustment step of relatively moving the needle thread accumulation amount control element, the upper looper thread accumulation amount control element, and the lower looper thread accumulation amount control element with respect to the upstream thread accumulating element and the downstream thread accumulating element according to the thread amount allocated to each of the needle thread, the upper looper thread, and the lower looper thread thereby to adjust, in an increasable or decreasable manner, the sewing thread amount of each of the needle thread, the upper looper thread, and the lower looper thread required for sewing one stitch.

7. The thread feeding device of a decorative stitch sewing machine according to claim 6, comprising a thread accumulating element actuation detection device, which detects a moment of closure of the downstream gripper, applies data of the detection to the thread feed control unit, and carries out the thread accumulation amount adjustment step before the thread accumulation amount measurement step for a next stitch is started after the completion of the thread release step.

8. The thread feeding device of a decorative stitch sewing machine according to claim 2, wherein the thread accumulation step of accumulating, by the thread accumulator, each of the needle thread, the upper looper thread, and the lower looper thread in the sewing thread amount required for sewing one stitch in the fabric feeding step of one stitch immediately before a stitch forming step of one stitch includes:

a thread accumulation amount measurement step of moving the upstream thread accumulating element and the downstream thread accumulating element to measure the thread accumulation amount of the predetermined length of each of the needle thread, the upper looper thread, and the lower looper thread;

a thread accumulation amount calculation step of increasing or decreasing the total thread feeding amount of the needle thread, the upper looper thread, and the lower looper thread according to the fabric feeding amount, the fabric thickness, the overlocking width, and the shape of the stitching decoration pattern, and then allocating a calculation result to each of the needle thread, the upper looper thread, and the lower looper thread; and a thread accumulation amount adjustment step of relatively moving the needle thread accumulation amount control element, the upper looper thread accumulation amount control element, and the lower looper thread accumulation amount control element with respect to the upstream thread accumulating element and the downstream thread accumulating element according to the thread amount allocated to each of the needle thread, the upper looper thread, and the lower looper thread thereby to adjust, in an increasable or decreasable manner, the sewing thread amount of each of the needle thread, the upper looper thread, and the lower looper thread required for sewing one stitch.

9. The thread feeding device of a decorative stitch sewing machine according to claim 2, wherein the thread feed drive mechanism is composed of a pulse motor controlled by the thread feed control unit, and a rack pinion which performs motion conversion to convert a rotation of the pulse motor into a displacement of the needle thread accumulation amount control element, the upper looper thread accumulation amount control element, and the lower looper thread accumulation amount control element of the thread accumulator, and is adapted to feed and drive each of the needle thread, the upper looper thread, and the lower looper thread.

10. The thread feeding device of a decorative stitch sewing machine according to claim 2, comprising a fabric feeding amount detection device, which detects a fabric feeding amount set by the fabric feeding device that adjusts the fabric feeding amount of the fabric, and applies data of the detection to the thread feed control unit.

11. The thread feeding device of a decorative stitch sewing machine according to claim 2, comprising an overlocking width detection device, which detects an overlocking width set by an overlocking width adjustment unit that adjusts the overlocking width, and applies data of the detection to the thread feed control unit.

12. The thread feeding device of a decorative stitch sewing machine according to claim 2, comprising a fabric thickness detection device, which detects the fabric thickness, and applies data of the detection to the thread feed control unit.

13. The thread feeding device of a decorative stitch sewing machine according to claim 1, wherein the program includes:

a step of determining the sewing thread amount of each of the needle thread, the upper looper thread, and the lower looper thread according to relative displacement positions of the upstream thread accumulating element and the downstream thread accumulating element in relation to, the needle thread accumulation amount control element, the upper looper thread accumulation amount control element, and the lower looper thread accumulation amount control element in the thread accumulator.

14. The thread feeding device of a decorative stitch sewing machine according to claim 13, wherein the thread accumulation amount adjustment step is carried out before the thread accumulation amount measurement step for the next one stitch is started, after the completion of the thread release step.

15. The thread feeding device of a decorative stitch sewing machine according to claim 1, wherein the thread feed drive mechanism is composed of a pulse motor controlled by the thread feed control unit, and a rack pinion which performs motion conversion to convert a rotation of the pulse motor into a displacement of the needle thread accumulation amount control element, the upper looper thread accumulation amount control element, and the lower looper thread accumulation amount control element of the thread accumulator, and is adapted to feed and drive each of the needle thread, the upper looper thread, and the lower looper thread.

16. The thread feeding device of a decorative stitch sewing machine according to claim 1, comprising a fabric feeding amount detection device, which detects a fabric feeding amount set by the fabric feeding device that adjusts the fabric feeding amount of the fabric, and applies data of the detection to the thread feed control unit.

17. The thread feeding device of a decorative stitch sewing machine according to claim 1, comprising an overlocking width detection device, which detects an overlocking width set by an overlocking width adjustment unit that adjusts the overlocking width, and applies data of the detection to the thread feed control unit.

18. The thread feeding device of a decorative stitch sewing machine according to claim 1, comprising a fabric thickness detection device, which detects the fabric thickness, and applies data of the detection to the thread feed control unit.

* * * * *